US005862227A

United States Patent [19]

Orduña-Bustamante et al.

[11] Patent Number: 5,862,227

[45] Date of Patent: Jan. 19, 1999

[54] SOUND RECORDING AND REPRODUCTION SYSTEMS

[75] Inventors: Felipe Orduña-Bustamante, Circuito Exterior Cu, Mexico; Ole Kirkeby; Hareo Hamada, both of Tokyo, Japan; Philip Arthur Nelson, Southampton, United Kingdom

[73] Assignee: Adaptive Audio Limited, United Kingdom

[21] Appl. No.: 793,542

[22] PCT Filed: Aug. 24, 1995

[86] PCT No.: PCT/GB95/02005

§ 371 Date: Jul. 25, 1997

§ 102(e) Date: Jul. 25, 1997

[87] PCT Pub. No.: WO96/06515

PCT Pub. Date: Feb. 29, 1996

[30] Foreign Application Priority Data

Aug. 25, 1994 [GB] United Kingdom ..... 9417185

[51] Int. Cl.[6] ..... H04S 5/00

[52] U.S. Cl. ..... 381/17

[58] Field of Search ..... 381/1, 17

[56] References Cited

U.S. PATENT DOCUMENTS 5,404,406 4/1995 Fuchigami et al. ..... 381/26

5,521,981 5/1996 Gehring ..... 381/26

5,727,066 3/1988 Elliott et al. ..... 381/1

*Primary Examiner*—Forester W. Isen

*Attorney, Agent, or Firm*—Christensen O'Connor Johnson & Kindness PLLC

[57] ABSTRACT

A method of recording sound for reproduction by a plurality of loudspeakers, or for processing sound for reproduction by a plurality of loudspeakers, is described in which some of the reproduced sound appears to a listener to emmanate from a virtual source which is spaced from the loudspeakers. A filter means (H) is used either in creating the recording, or in processing the recorded signals for supply to loudspeakers, the filter means (H) being created in a filter design step in which: a) a technique is employed to minimise error between the signals (w) reproduced at the intended position of a listener on playing the recording through the loudspeakers, and desired signals (d) at the intended position, wherein: b) said desired signals (d) to be produced at the listener are defined by signals (or an estimate of the signals) that would be produced at the ears of (or in the region of) the listener in said intended position by an source at the desired position of the virtual source. A least squares technique may be employed to minimise the time averaged error between the signal reproduced at the intended position of a listener and the desired signal, or it may be applied to the frequency domain.

14 Claims, 21 Drawing Sheets

*a) Left loudspeaker-left ear*

*b) Left loudspeaker-right ear*

*c) Right loudspeaker-left ear*

*d) Right loudspeaker-right ear*

*a) Left loudspeaker-left ear*

*b) Left loudspeaker-right ear*

*c) Right loudspeaker-left ear*

*d) Right loudspeaker-right ear*

SOUND RECORDING AND REPRODUCTION SYSTEMS

CROSS-REFERENCE TO RELATED APPLICATION

Figure 1:
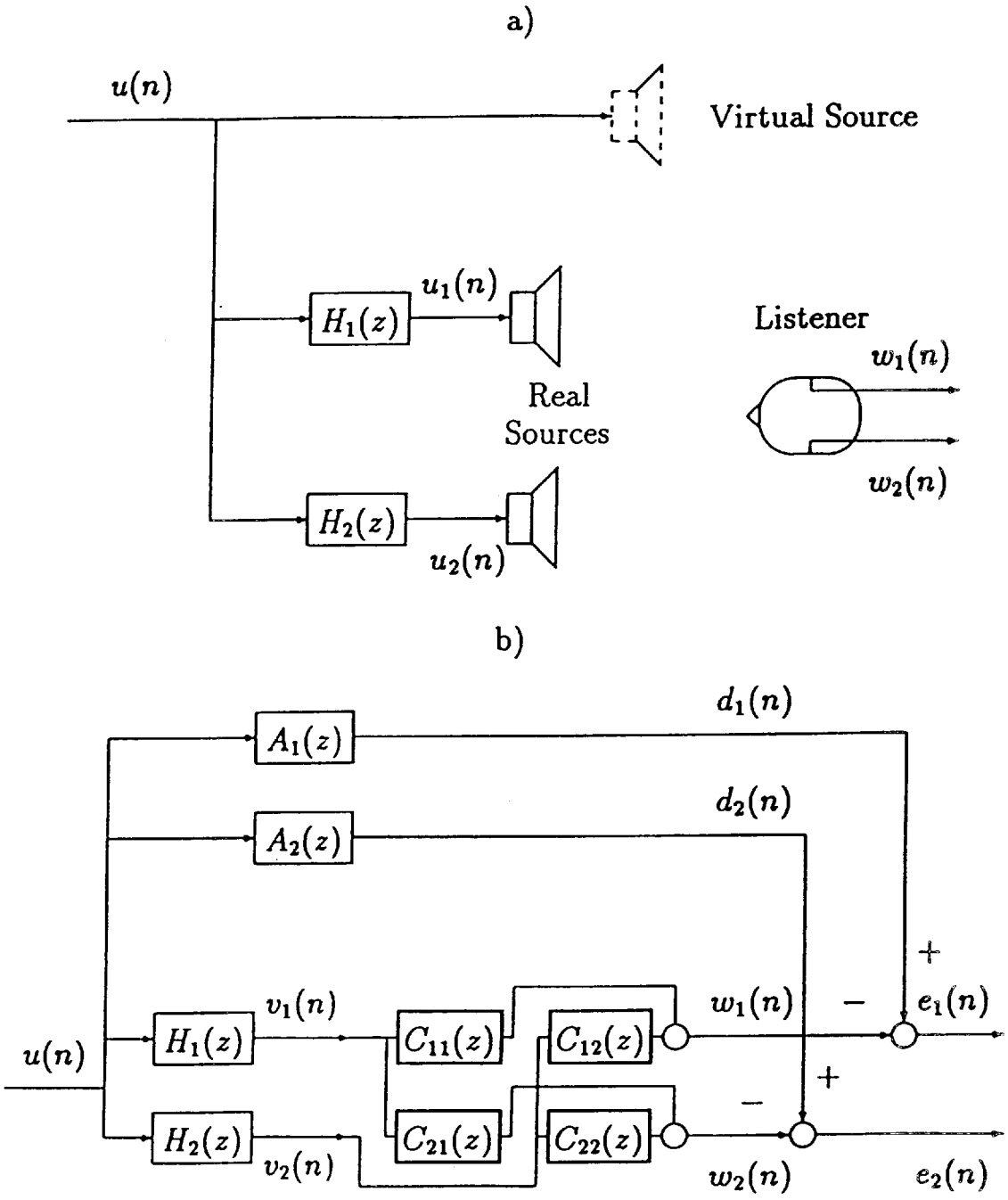

This application is the U.S. national phase of International Application No. PCT/GB95/02005, filed Aug. 24, 1995, designating, the United States.

This invention relates to sound recording and reproduction systems.

INTRODUCTION

The invention provides a new method for recording and reproducing sound. The method described is based in general on the use of multi-channel digital signal processing techniques and can be directly applied to the improvement of methods used to create recordings for the subsequent reproduction of sound by two or more loudspeakers using conventional multi-channel reproduction systems. The techniques used can also be extended to process conventionally recorded sound signals for reproduction by multiple loudspeakers, and the recorded signal could on occasion be a single channel signal.

The general approach of using digital filters during reproduction to process recorded signals in order to improve the reproduction of those signals has been described in references [1, 2]. The use of such techniques in order to compensate for poorly positioned loudspeakers used to reproduce existing two-channel recordings has also been described in references [3, 4]. In that latter work, the notion of "virtual" loudspeaker positions was introduced. The signal processing scheme used filters to operate on the recorded signals during reproduction in order to ensure that the sum of the time averaged squared errors between the reproduced signals and the "desired" signals were minimised. The desired signals were in turn specified as those in the sound field that would be produced by a source of sound in a particular specified position. With the filters in operation, then the signals reproduced would give a good match to the desired signals, thereby creating the illusion in a listener of sound emanating from the position of the "virtual source".

The present invention again utilises the notion of a virtual source. An object of the present invention is to provide a means for recording sound for reproduction via two (or more) loudspeakers in order to create the illusion in a listener of sound appearing to come from a specified spatial position, which can be remote from the actual positions of the loudspeakers.

A technique for achieving this objective during reproduction was first described by Atal and Schroeder [5] who proposed a method for the production of "arbitrarily located sound images with only two loudspeakers". In their invention, entitled the "Apparent sound source translator " Atal and Schroeder also used filter networks to operate on a single signal prior to its input to two loudspeakers.

According to one aspect of the present invention we provide a method of recording sound for reproduction by a plurality of loudspeakers, or for processing sound for reproduction by a plurality of loudspeakers, in which some of the reproduced sound appears to a listener to emanate from a virtual source which is spaced from the loudspeakers, comprises utilising filter means (H) in creating the recording, or in processing the signals for supply to loudspeakers, the filter means (H) being created in a filter design step, the filter design step being characterised by:

a) a technique being employed to minimise error between the signals (w) reproduced at the intended position of a listener on playing the recording through the loudspeakers, and desired signals (d) at the intended position. wherein b) said desired signals (d) to be produced at the listener are defined by signals (or an estimate of the signals) that would be produced at the ears of (or in the region of) the listener in said intended position by a source at the desired position of the virtual source.

Preferably the desired signals are, in turn, deduced by specifying, in the form of filters (A), the transfer functions between said desired position of the virtual source and specific positions in the reproduced sound field which are at the ears of the listener or in the region of the listener's head.

The transfer functions could be derived in various ways, but preferably the transfer functions are deduced by first making measurements between the input to a real source and the outputs from microphones at the ears of (or in the region of) a dummy head used to model the effect of the "Head Related Transfer Functions" (HRTF) of the listener.

A least squares technique may be employed to minimise the time averaged error between the signals reproduced at the intended position of a listener and the desired signals.

Alternatively, a least squares technique is applied to a frequency rather than a time domain.

The transducer functions may be deduced by first making measurements on a real listener or by using an analytical or empirical model of the Head Related Transfer Function (HRTF) of the listener.

Preferably the filters used to process the virtual source signal prior to input to the loudspeakers to be used for reproduction are deduced by convolution of the digital filters representing the transfer function that specifies the desired signals with a matrix of "cross talk cancellation filters". Only a single inverse filter design procedure (which is numerically intensive) is then required.

The result of using the method in accordance with the first aspect of the invention is that, when only two loudspeakers are used, a listener will perceive sound to be coming from a virtual source which can be arbitrarily located at almost any position in the plane of the listener's ears. The system is found, however, to be particularly effective in placing virtual sources in the forward arc (to the front of the listener) of this plane.

By using two additional speakers to the rear of the listener it is possible to create virtual sources which are behind or to the side of the listener.

One use of the invention is in providing a means for producing improved two channel sound recordings. All the foregoing filter design steps can be undertaken in order to generate the two recorded signals ready for subsequent transmission without any necessary further processing via two loudspeakers.

Thus, a second aspect of the invention is a method of producing a multi-channel sound recording capable of being subsequently reproduced by playing the recording through a conventional multi-channel sound reproduction system, the method utilising the foregoing filter design steps.

It is clear that the recorded signals can be recorded using conventional media such as compact discs, analogue or digital audio tape or any other suitable means.

By superposition, such recordings can be made in order to attribute different instruments, vocalists and so forth with different virtual source locations. The production of recordings for reproduction via two loudspeakers is thereby improved.

Various embodiments of the invention will now be described, by way of example only, with reference to the accompanying drawing figures, in which:

FIG. 1 shows signal processing for virtual source location (a) in schematic form and (b) in block diagram form.

Figure 2:
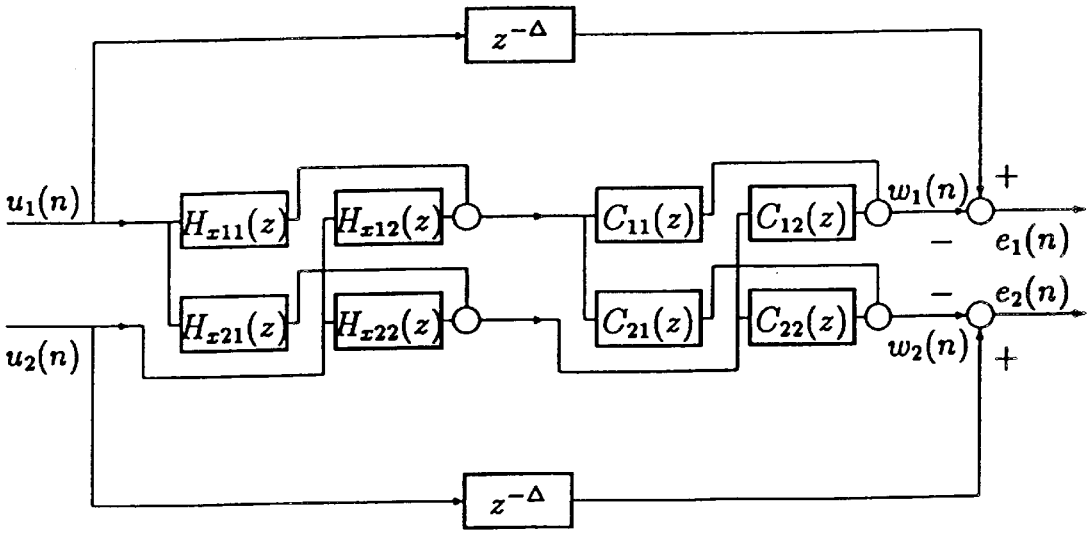
Figure 3:
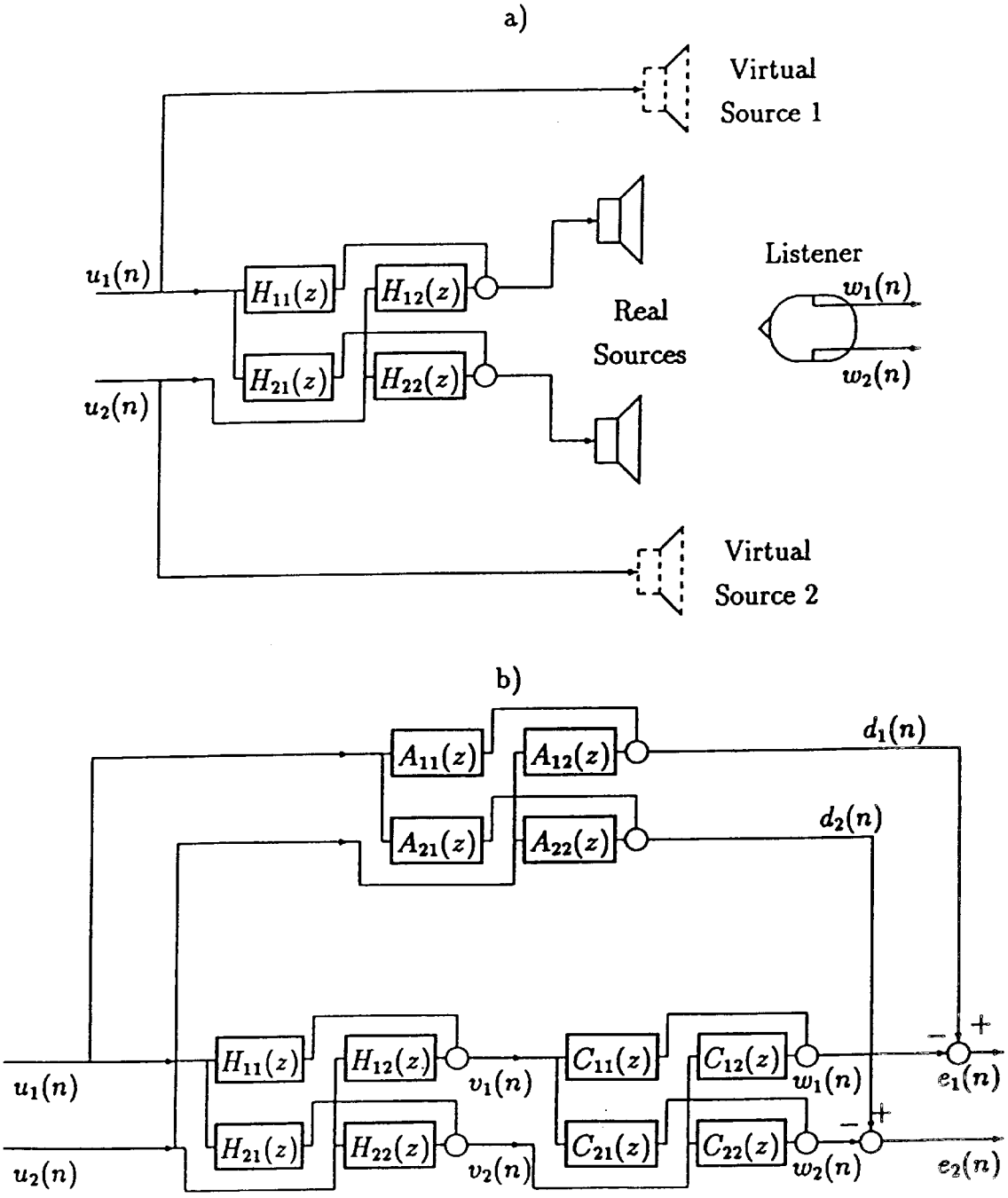
Figure 4:
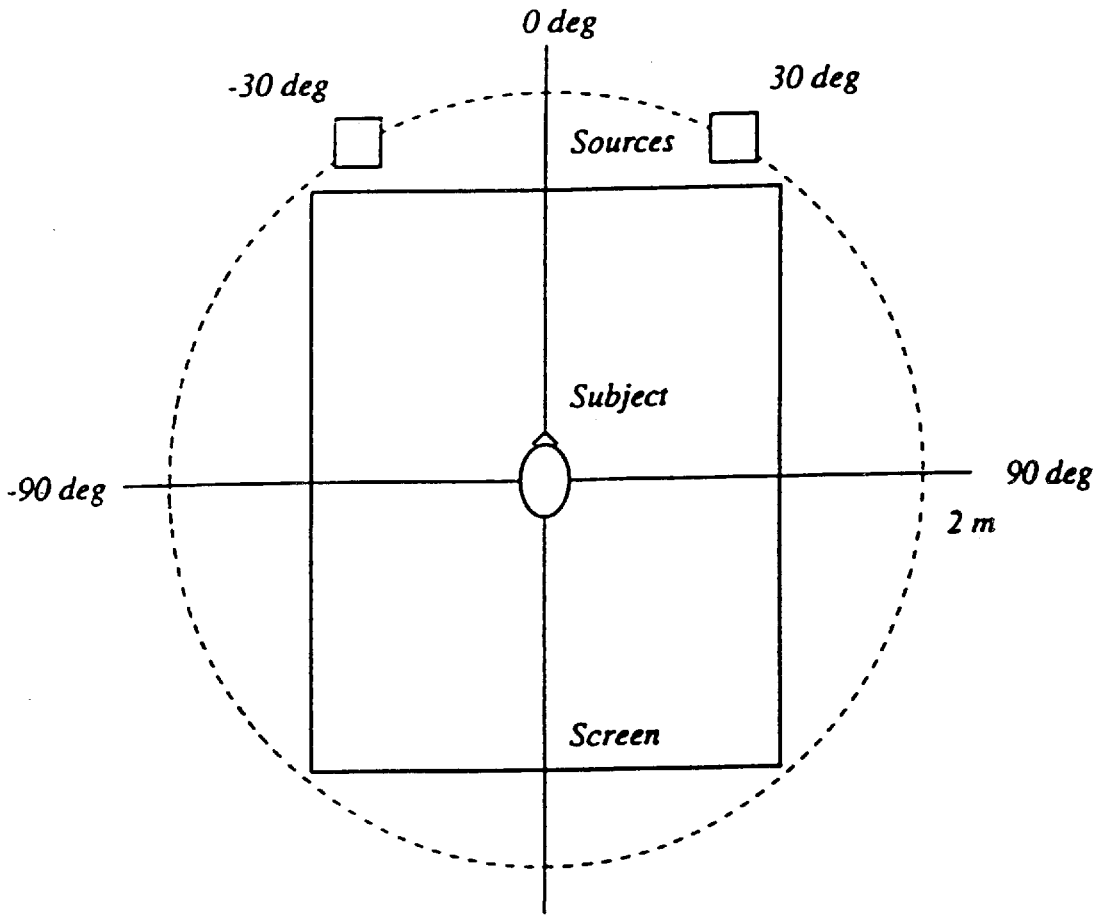
Figure 5:
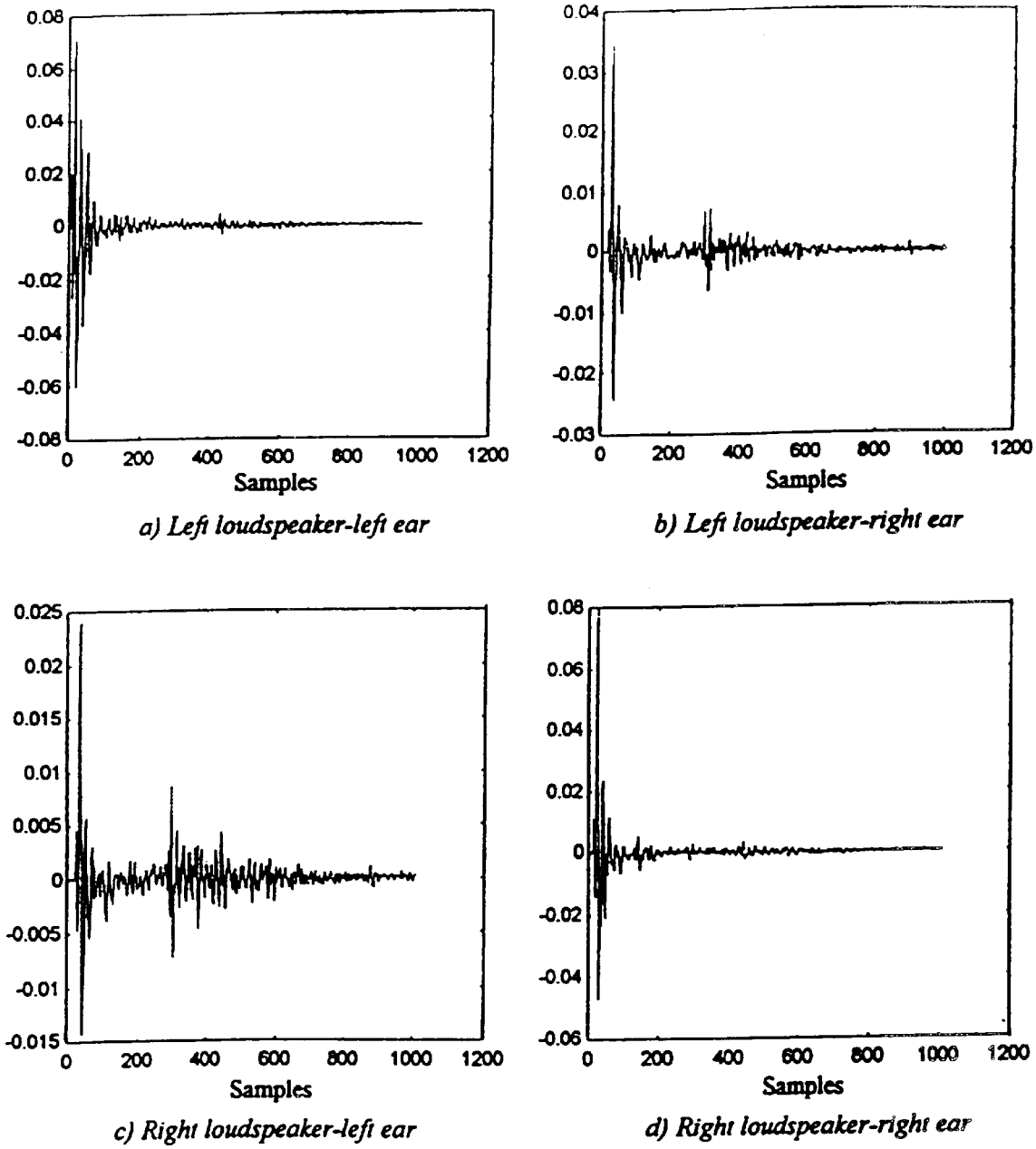
Figure 6:
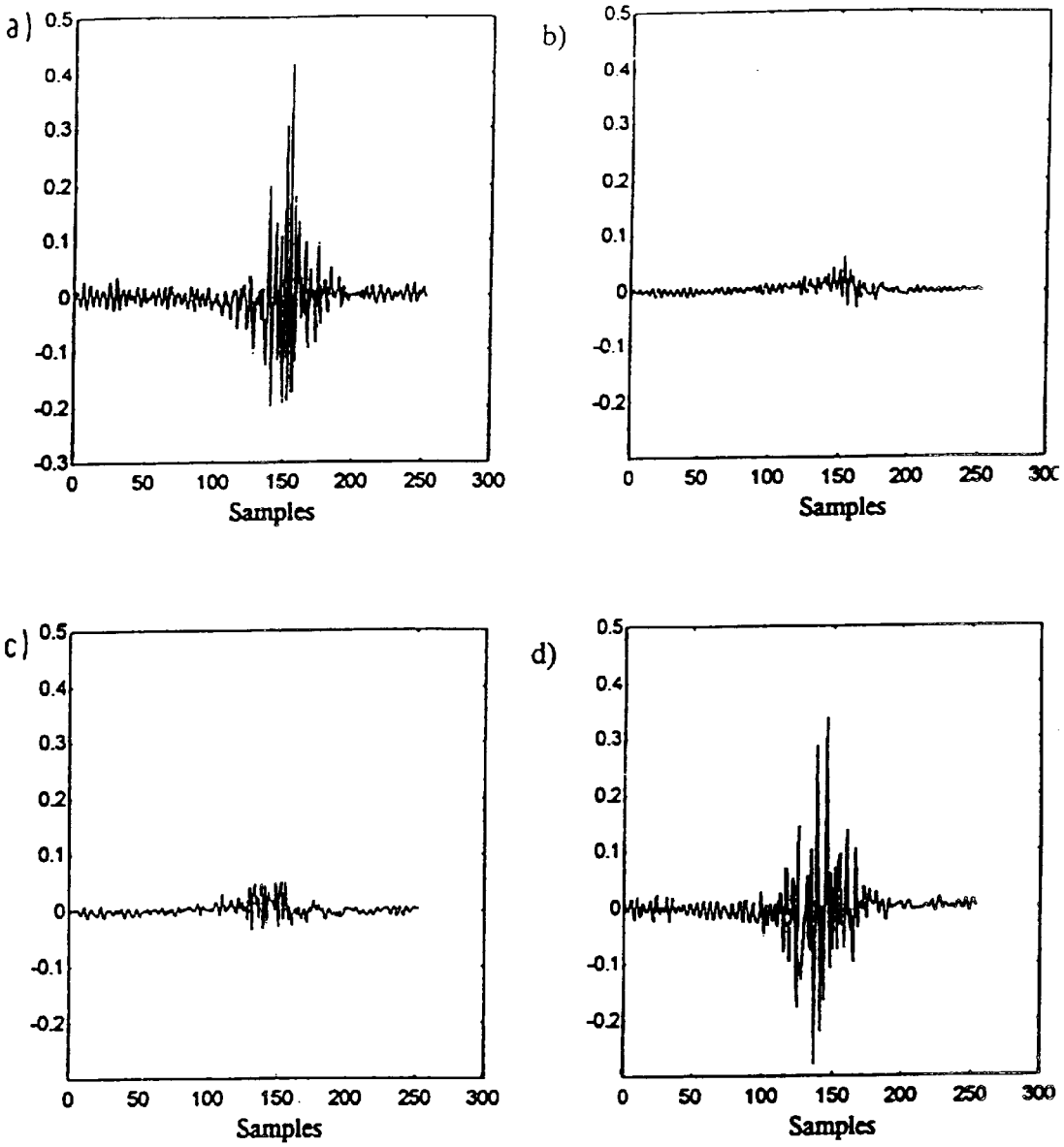
Figure 7:
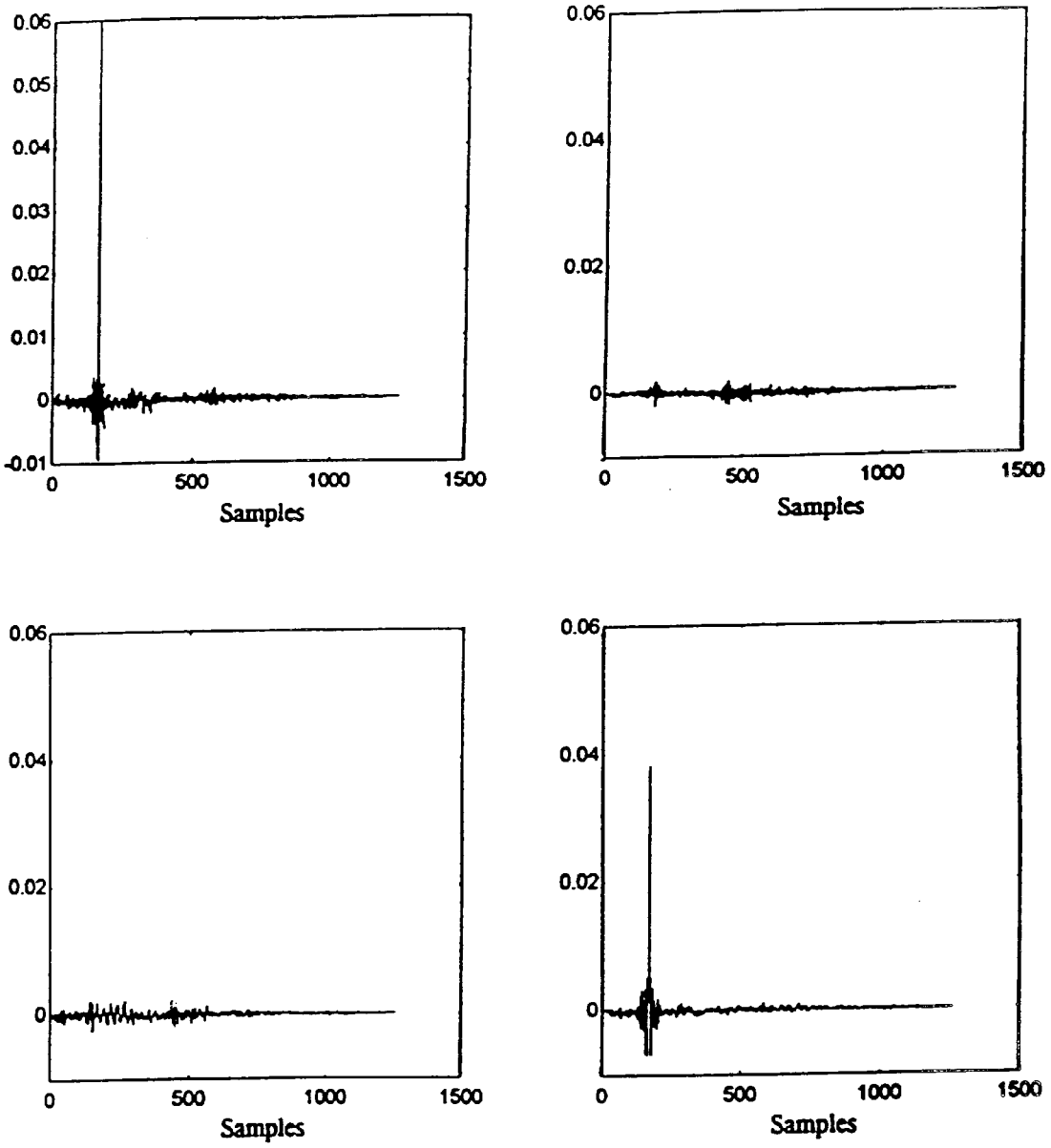
Figure 8:
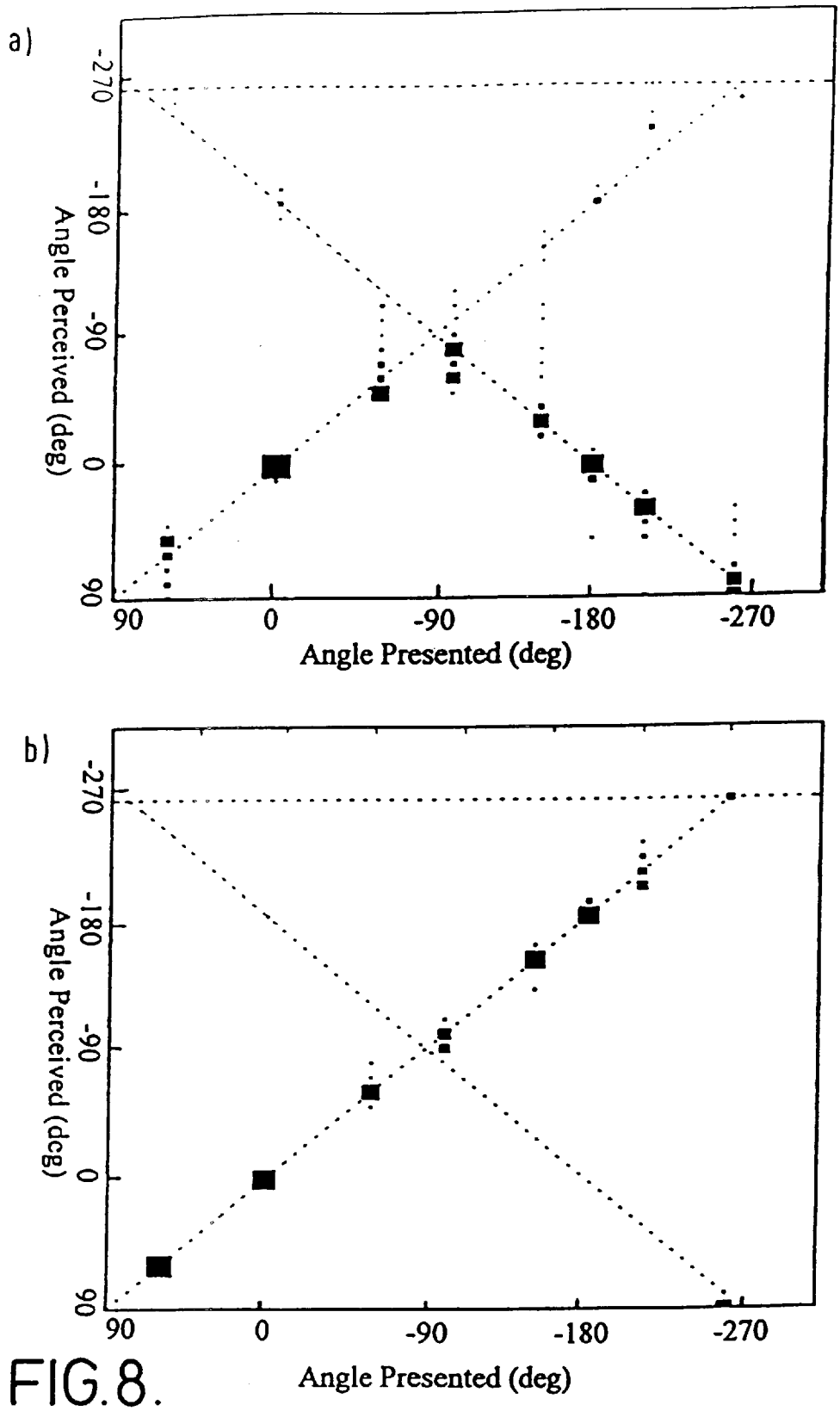
Figure 10:
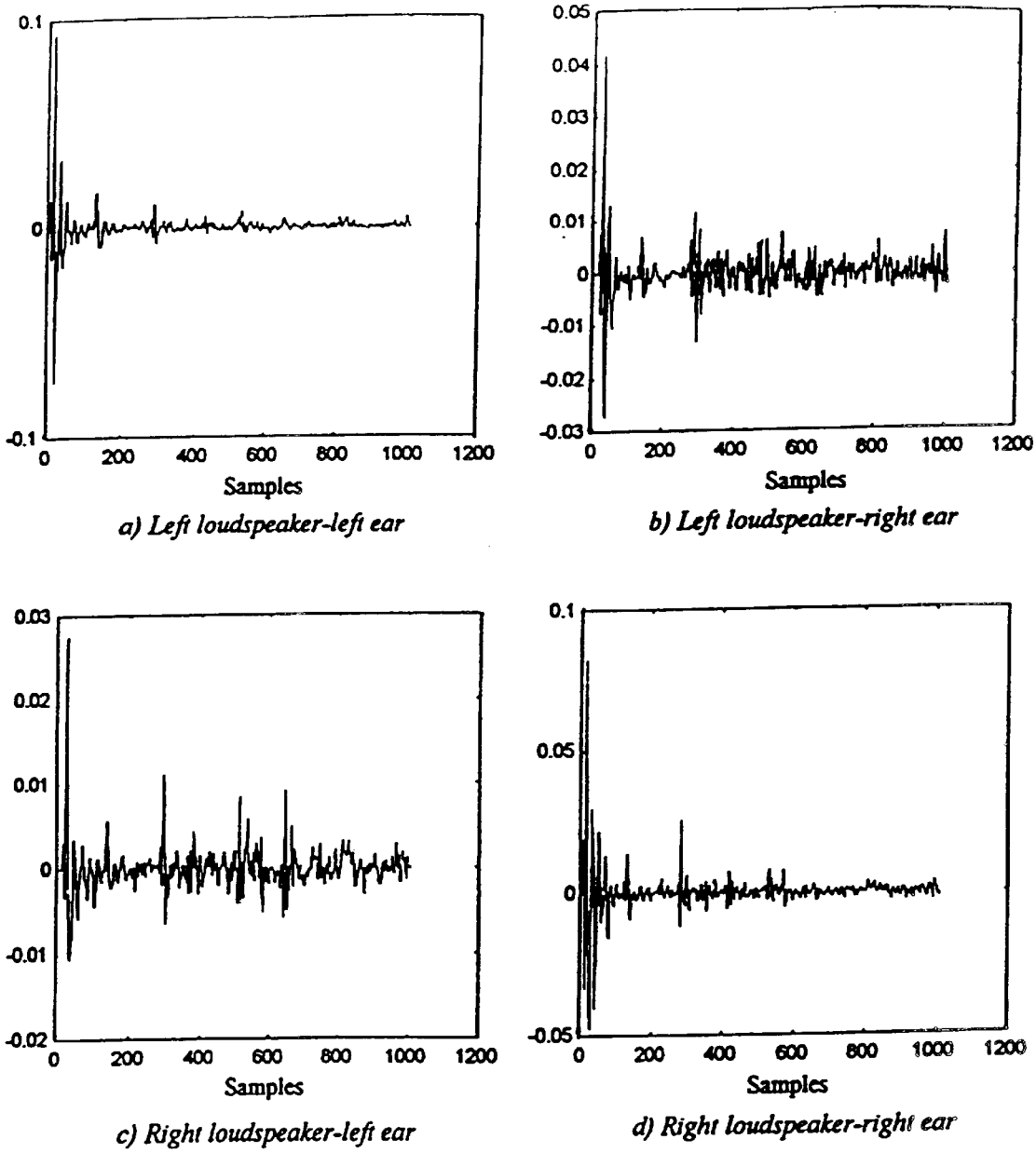
Figure 11:
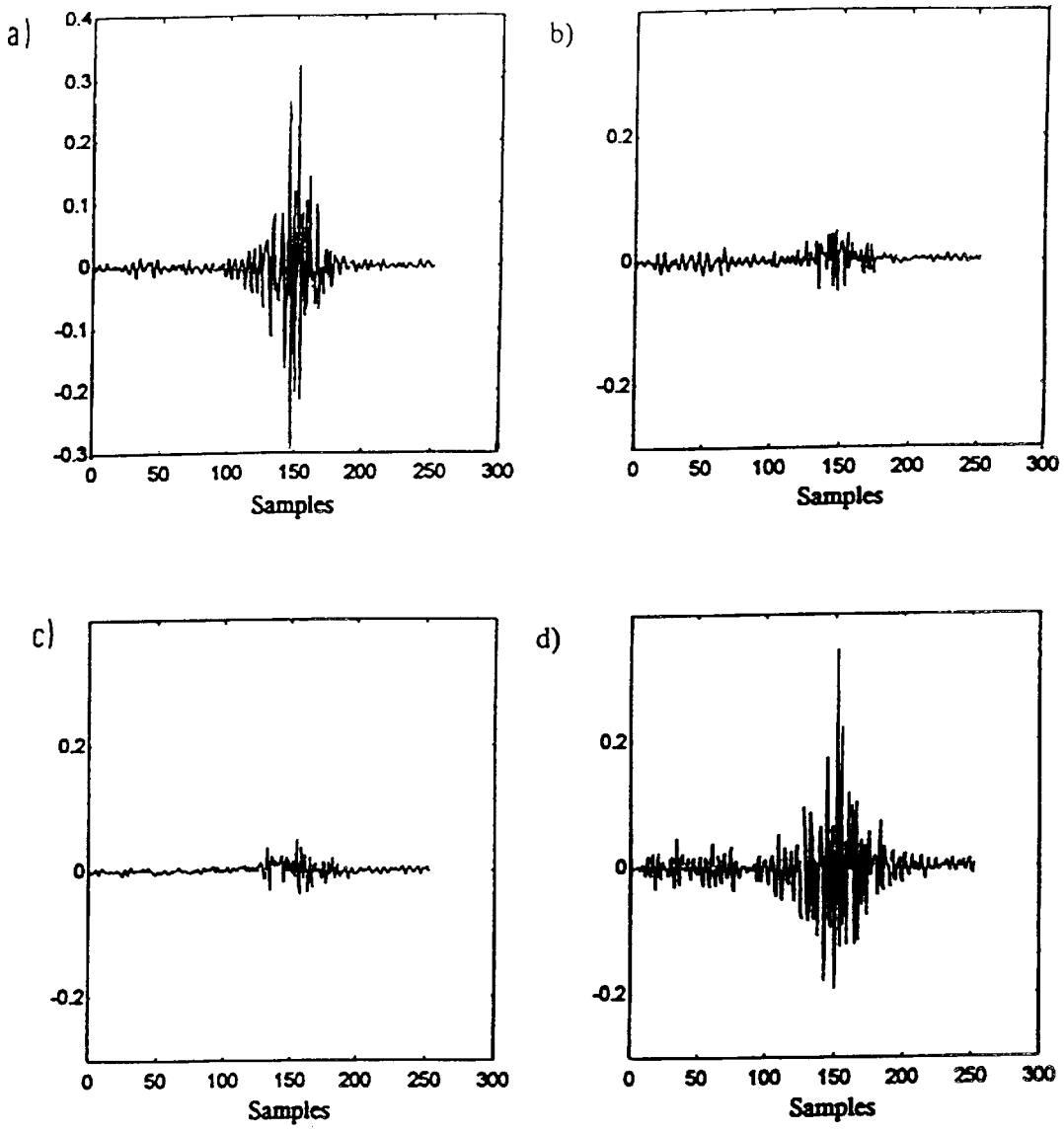
Figure 12:
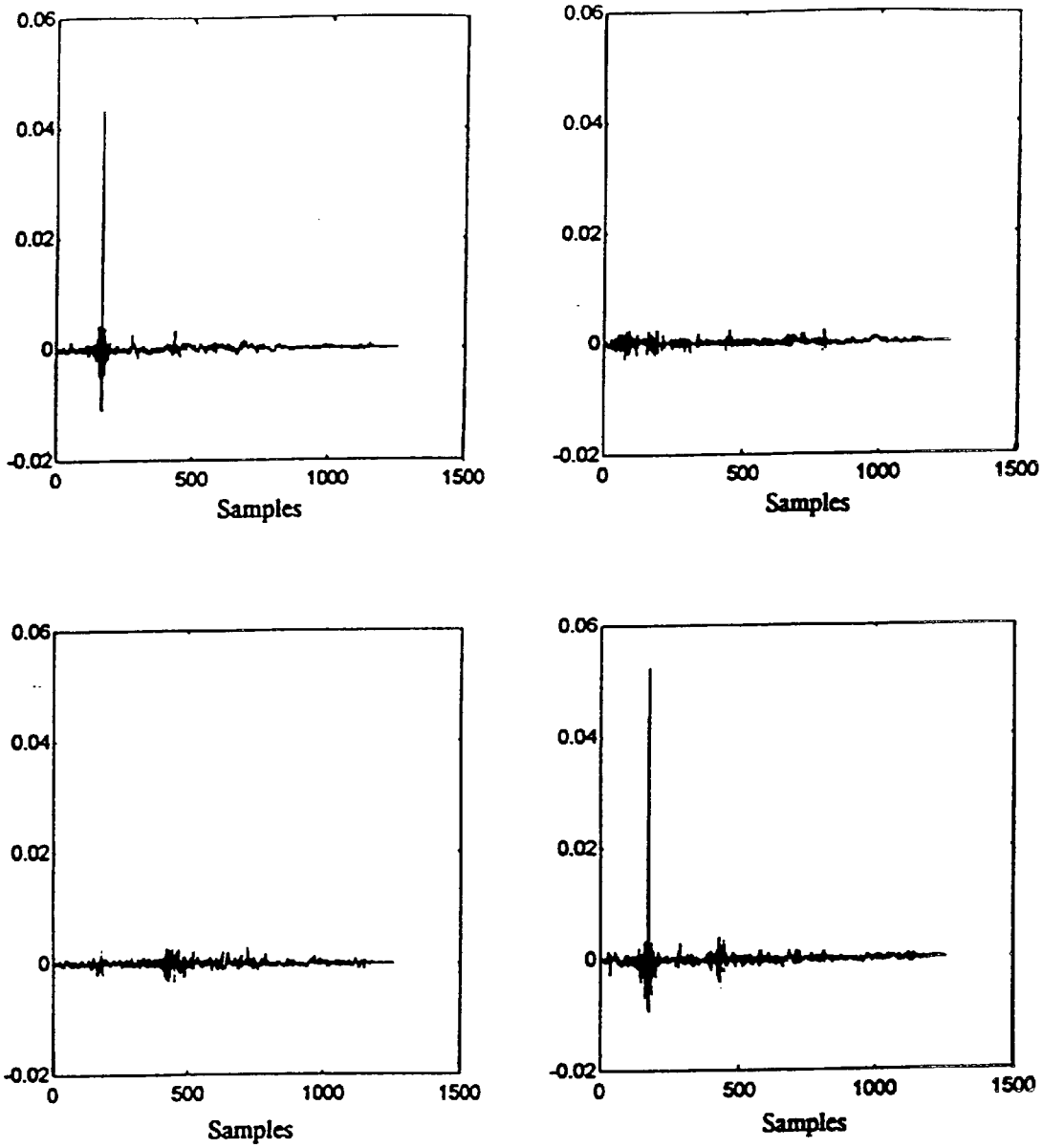
Figure 14:
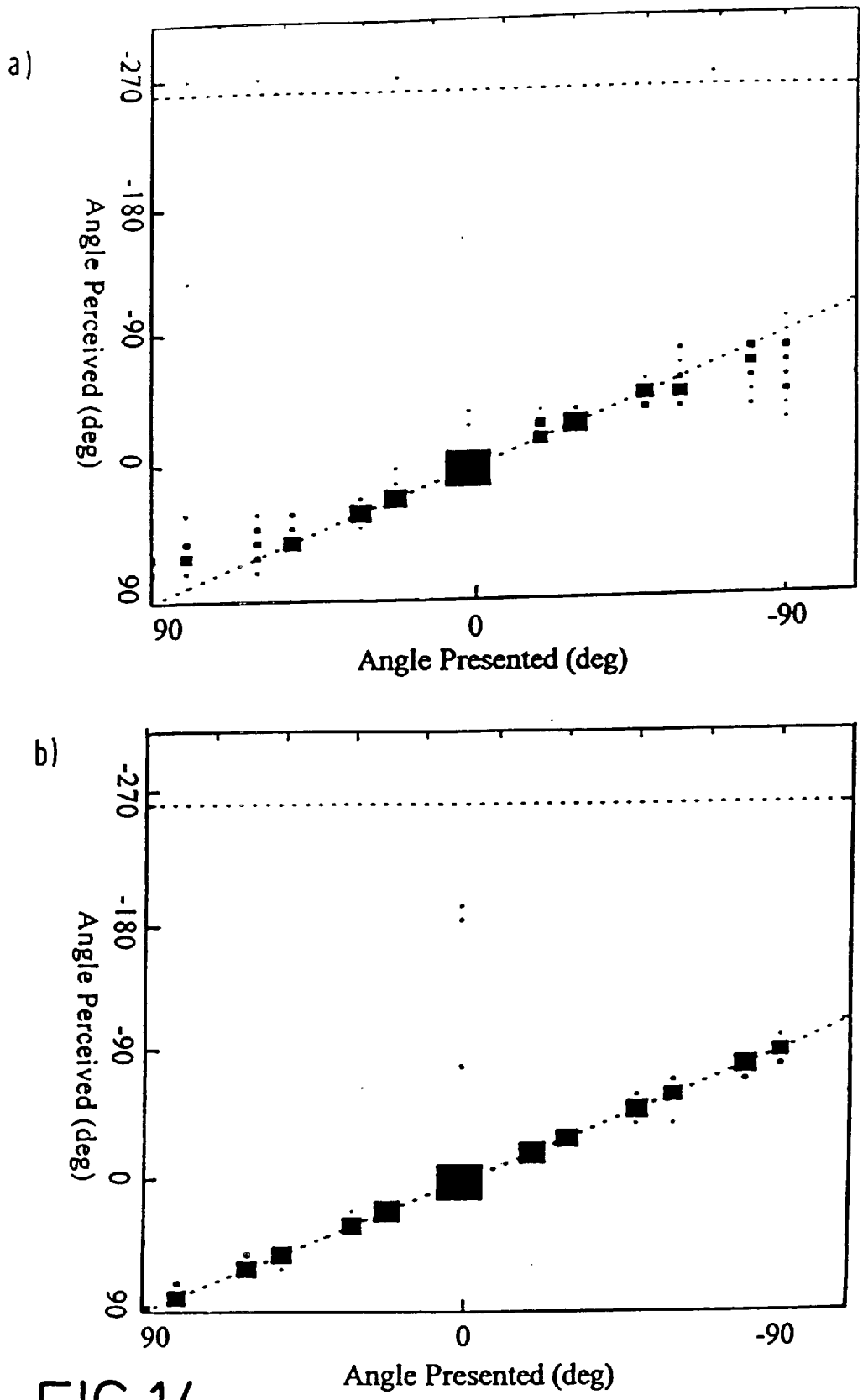
Figure 15:
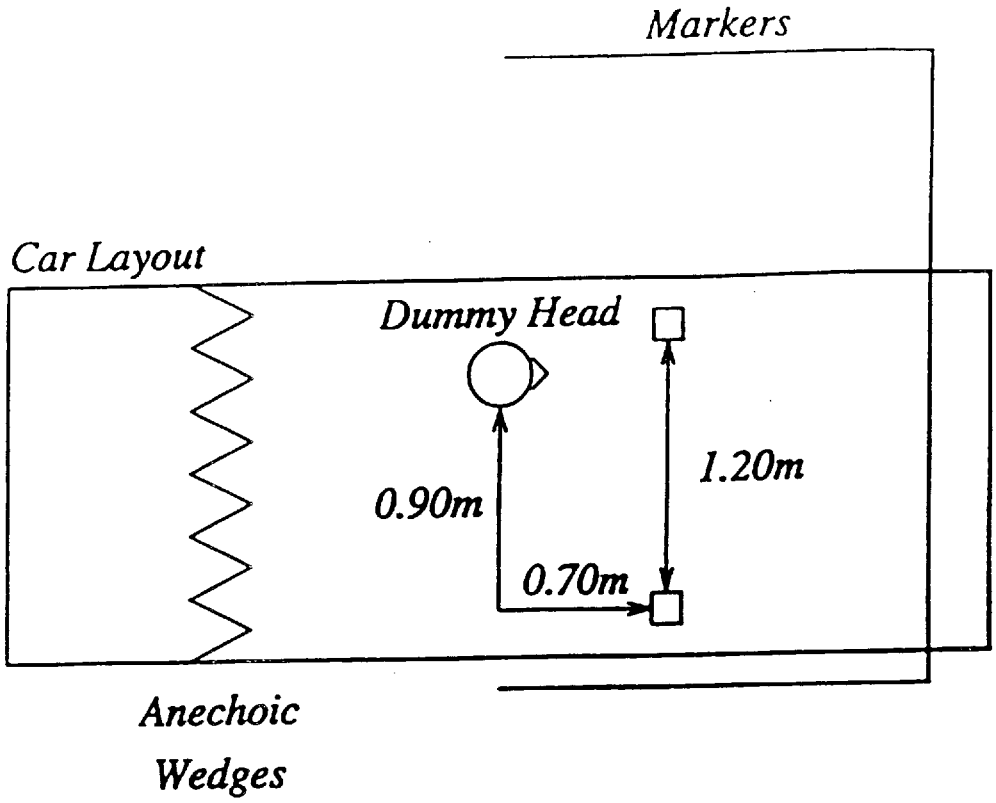
Figure 15:
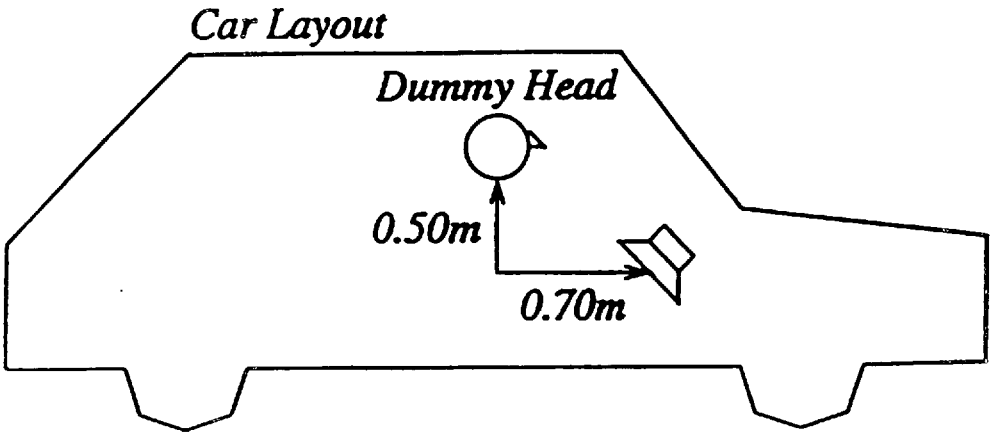
Figure 16:
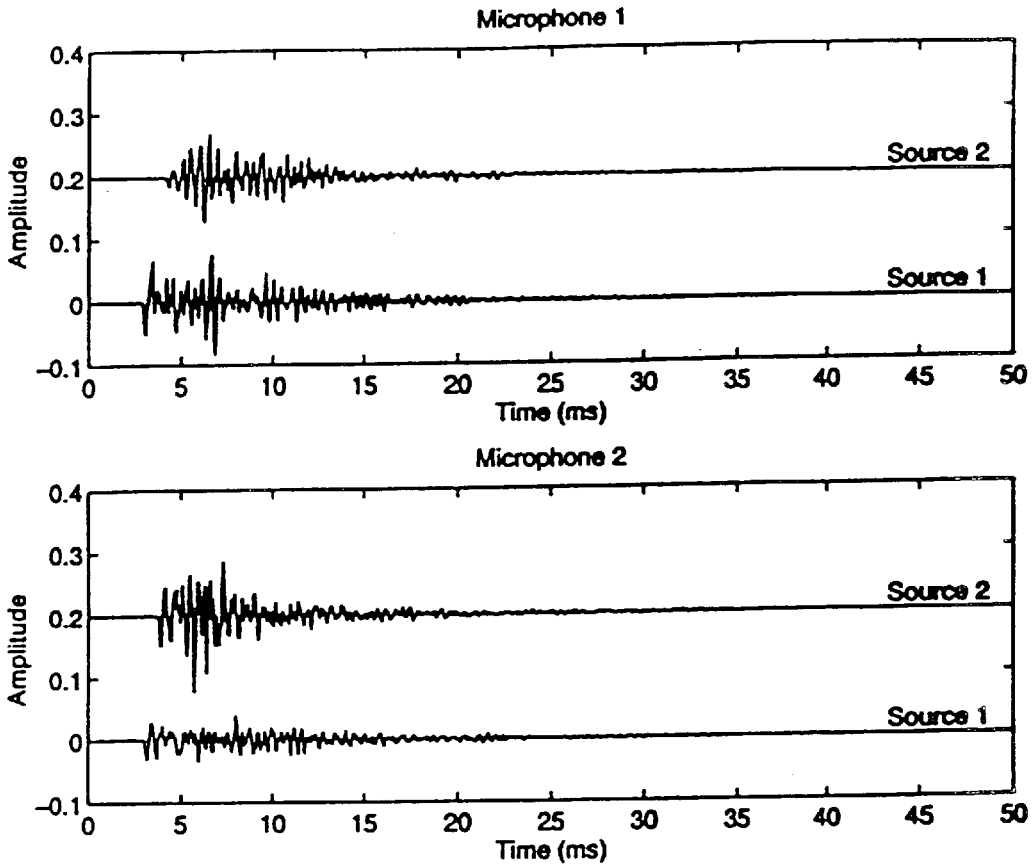
Figure 17:
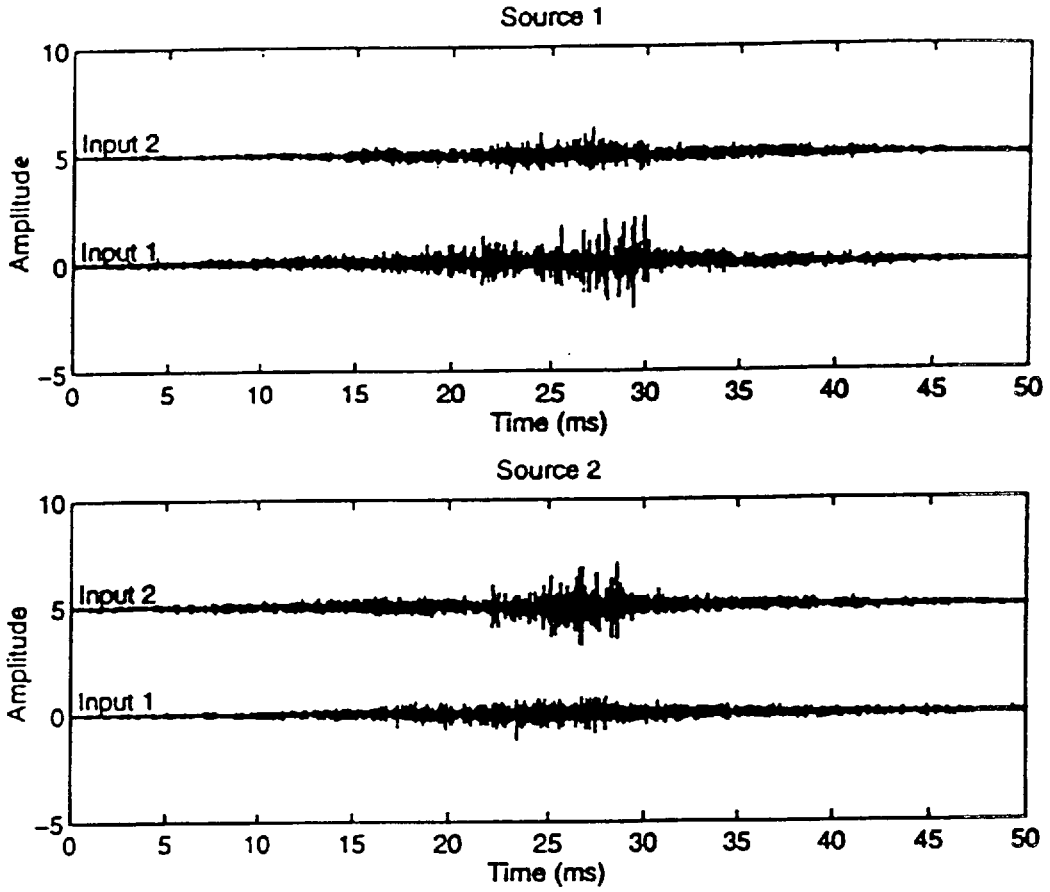
Figure 18:
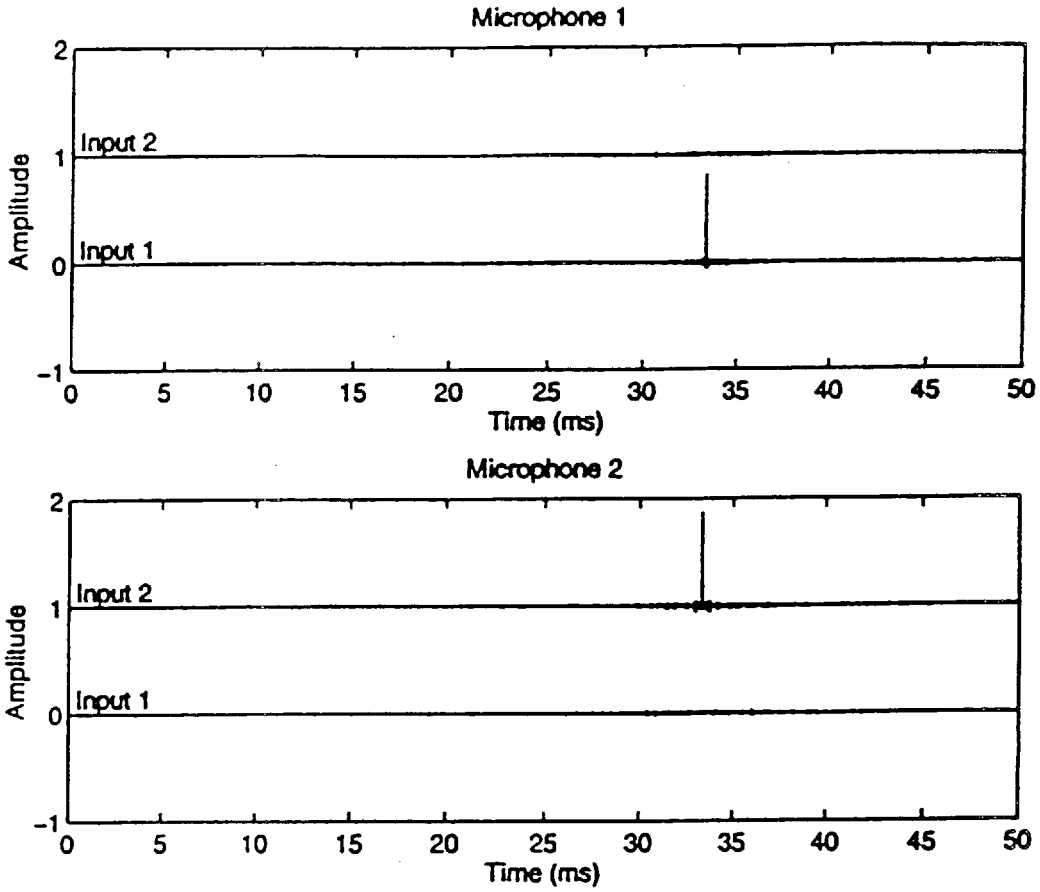
Figure 19:
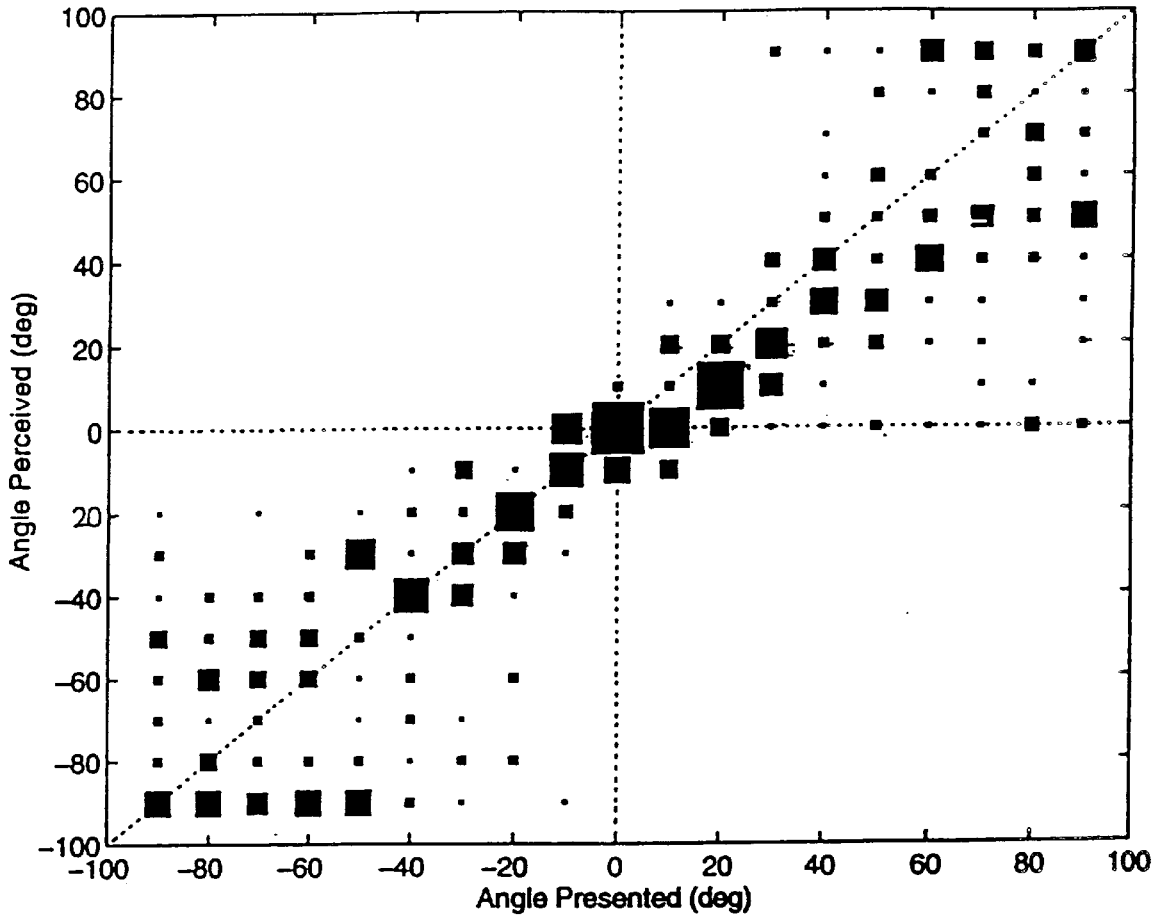
Figure 20:
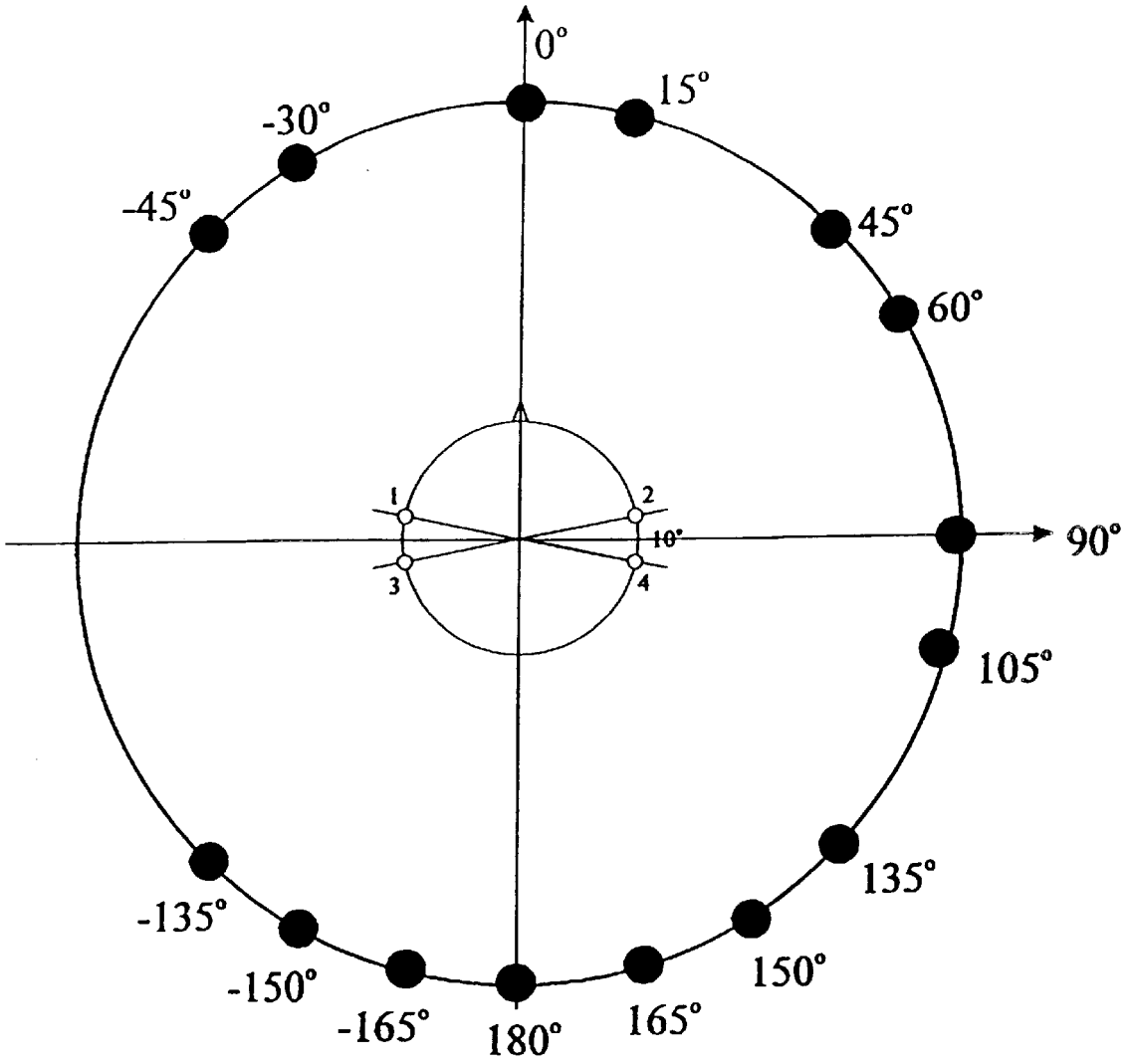
Figure 21:
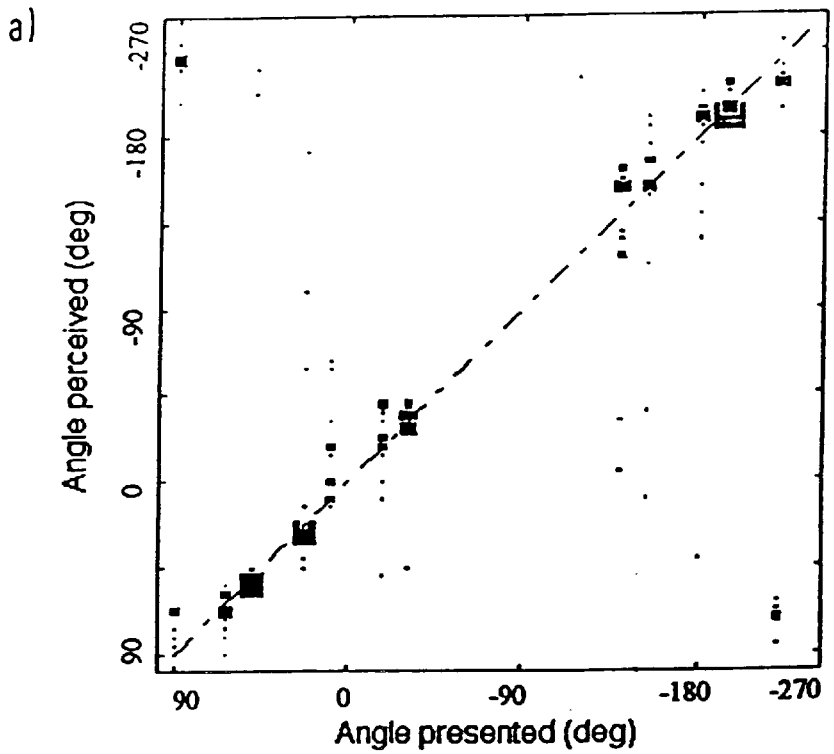
Figure 21:
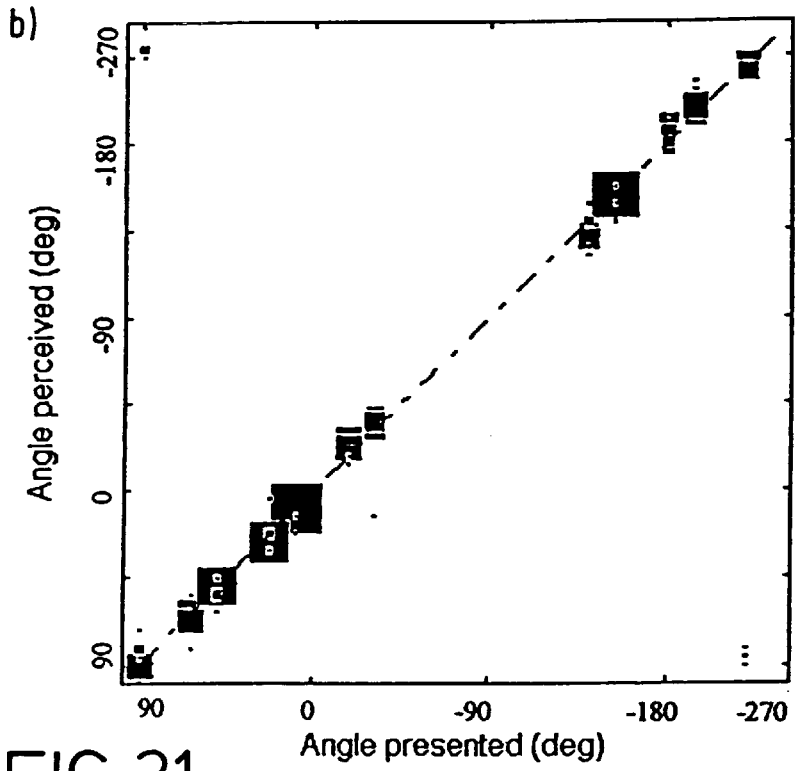

FIG. 2 shows the design of the matrix of cross talk cancellation filters. The filters $H_{x11}$, $H_{x21}$, $H_{x12}$ and $H_{22}$ are designed in the least squares sense in order to minimise the cost function $E[e_1^2(n)+e_1^2(n)]$. This ensures that, to a very good approximation, the reproduced signals $w_1(n)\approx d_1(n)$ and $w_2(n)\approx d_2(n)$. Thus $w_1(n)$ and $w_2(n)$ are simply delayed versions of the signal $u_1(n)$ and $u_2(n)$ respectively, FIG. 3 shows the loudspeaker position compensation problem shown (a) in outline and (b) in block diagram form. Note that the signals $u_1(n)$ and $u_2(n)$ denote those produced in a conventional stereophonic recording. The digital filters $A_{11}$, $A_{21}$, $A_{12}$ and $A_{22}$ denote the transfer functions between the inputs to 'ideally placed' virtual loudspeakers and the ears of the listener, FIG. 4 shows a layout used during the tests for subjective localisation of virtual sources. The virtual sources were emulated via the pair of sound sources shown facing the subject. A dark screen was used to keep the sound sources out of sight. The circle drawn outside the screen marks the distance at which virtual and additional real sources were placed for localisation at different angles, FIG. 5 shows impulse responses of an electroacoustic system in an anechoic chamber, a) left loudspeaker—left ear, b) left loudspeaker—right ear, c) right loudspeaker—left ear, d) right loudspeaker—right ear, FIG. 6 shows impulse responses of the matrix of cross-talk cancellation filters used in the anechoic chamber, a) $h_{11}(n)$, b)$h_{12}(n)$, c)$h_{21}(n)$, d)$h_{22}(n)$, FIG. 7 shows the matrix of filters resulting from the convolution of the impulse responses of the electroacoustic system in the anechoic chamber with the matrix of cross-talk cancellation filters, FIGS. 8 and 9 each show the results of localisation experiments in the anechoic chamber, using speech signal with a) virtual sources, b) real sources, FIG. 10 shows impulse responses of the electroacoustic system in a listening room: a) left loudspeaker—left ear, b) left loudspeaker—right ear, c) right loudspeaker—left ear, d) right loudspeaker—right ear, FIG. 11 shows impulse responses of a matrix of cross-talk cancellation filters used in the listening room, a)$h_{11}(n)$, b)$h_{12}(n)$, c)$h_{21}(n)$, d)$h_{22}(n)$, FIG. 12 shows the matrix of filters resulting from the convolution of the impulse responses for the electroacoustic system in the listening room with the matrix of cross-talk cancellation filters, FIGS. 13 and 14 each show results of localisation experiments in the listening room, using a speech signal with a) virtual sources, b) real sources, FIG. 15 shows layout of loudspeakers and dummy head in an automobile used for subjective experiments, a) top view, b) side view, FIG. 16 shows impulse responses measured from the front pair of loudspeakers in the automobile to the microphones at the ears of a dummy head sitting in the driver seat (in a left-hand drive car), FIG. 1 7 shows impulse response of cross-talk cancellation filters used in the automobile, FIG. 18 shows impulse responses from the input to the cross-talk cancellation filters to the microphones at the ears of the dummy head. These results were calculated by convolving the cross-talk cancellation filters shown in FIG. 17 with the impulse responses of the automobile shown in FIG. 16, FIG. 19 illustrates a subjective evaluation of virtual source location for the in-automobile experiments, FIG. 20 shows a layout for anechoic subjective evaluation, using database filters for inversion and target functions. The sources at ±45 and ±135 deg. were used to generate the virtual images. Real sources were placed at all of the source locations indicated with the exception of 165, −150 and −135 deg. Virtual sources were placed at all of the above locations except for 135, 1500 and −165 deg. The sources were at a radial distance of 2.2m from the centre of the KEMAR dummy head, and FIG. 21 shows the result of localisation experiments in the anechoic chamber using a speech signal and four sources for the emulation of virtual sources. a) Results for virtual sources. b) Results for real sources.

Signal processing techniques for the production of a single virtual source image using two loudspeakers.

The general signal processing problem is illustrated in FIG. 1. The discrete time signal u(n) defines the "virtual source signal" which we wish to attribute to a source at an arbitrary location with respect to the listener. The signals $d_1(n)$ and $d_2(n)$ are the "desired" signals produced at the ears of a listener by the virtual source. The digital filters $A_1(z)$ and $A_2(z)$ define the transfer functions between the virtual source position and the ears of the listener. Thus in the z-transform domain we have $$D_1(z)=A_1(z)U(z),\ D_2(z)=A_2(z)U(z) \tag{1a, b}$$

These transfer functions can typically be deduced by measuring the transfer function between the input to a high quality loudspeaker (or the pressure measured by a high quality microphone placed in the region of a loudspeaker), and the outputs of high quality microphones placed at the ears of a dummy head. Such experimental procedures are undertaken in anechoic conditions for a range of virtual source locations in order to derive a data base of Head Related Transfer Functions (HRTF's) associated with a range of virtual source positions. Alternatively, the data base may be defined by using an analytical or empirical model of these HRTFs.

Returning to FIG. 1, the signals $v_1(n)$ and $v_2(n)$ define the inputs to the loudspeakers used for reproduction. These signals will constitute the "recorded signals". In the process of transmission via the loudspeakers to the listeners ears, the recorded signals pass via the matrix of electroacoustic transfer functions whose elements are $C_{11}(z)$, $C_{12}(z)$, $C_{21}(z)$ and $C_{22}(z)$. These transfer functions relate the signals $v_1(n)$ and $v_2(n)$ to the signals $w_1(n)$ and $w_2(n)$ reproduced at the ears of a listener. Thus in the z-transform domain we can write $$\begin{bmatrix} W_1(z) \\ W_2(z) \end{bmatrix} = \begin{bmatrix} C_{11}(z) & C_{12}(z) \\ C_{21}(z) & C_{22}(z) \end{bmatrix} \begin{bmatrix} V_1(z) \\ V_2(z) \end{bmatrix} \tag{2}$$

Similarly to the transfer functions $A_1(z)$ and $A_2(z)$ the transfer functions $C_{11}(z)$, $C_{12}(z)$, $C_{21}(z)$ and $C_{22}(z)$ can be deduced by measurements, under anechoic conditions, of the transfer functions between the inputs to two loudspeakers and the outputs of microphones at the ears of a dummy head. Again, other techniques may be used to specify these transfer functions. In deducing the appropriate signal processing scheme for the production of recordings, it is obviously necessary to ensure that the filters used to represent these transfer functions are closely representative of the transfer functions likely to be encountered when the recordings are reproduced.

Assuming an adequate representation of the transfer functions $C_{11}(z)$, $C_{12}(z)$, $C_{21}(z)$ and $C_{22}(z)$, it is then possible to deduce the inverse filters $H_1(z)$ and $H_2(z)$ which operate on the virtual source signal u(n). This enables the production of the signals $v_1(n)$ and $v_2(n)$ to be recorded ready for later transmission via two loudspeakers. Following the techniques outlined in references [1, 2, 3, 4] we can use a least squares method in order to deduce the coefficients of $H_1(z)$ and $H_2(z)$ (which are assumed to be finite impulse response digital filters). The procedure used to design these filters is fully described in references [1, 2, 3, 4] and will not be repeated here. Nevertheless it is important to note that a least squares approach is used which optimises the coefficients of the filters $H_1(z)$ and $H_2(z)$ in order to minimise the cost function given by $$J=E[e_1^2(n)+e_2^2(n)] \tag{3}$$

where E[ ] is the expectation operator. Note that such a least squares procedure can produce very low time averaged squared values of the error signals $e_1(n)$ and $e_2(n)$ which quantify the difference between the desired signals $d_1(n)$ and $d_2(n)$ and the reproduced signals $w_1(n)$ and $w_2(n)$. It may also be useful under some circumstances to add a term to the cost function defined in equation (3) which penalises the sum of the squared magnitudes of the filter coefficients used in the filters $H_1(z)$ and $H_2(z)$ in order to improve the conditioning of the inversion problem. This procedure is again described more fully in references [3, 4]

However, to be of utility as a sound recording technique, it is clearly necessary to design inverse filters $H_1(z)$ and $H_2(z)$ for each virtual source location required. Since the filter design process is very lengthy (especially at the high sample rates necessary in high quality sound reproduction), to design such filters for each location is a massively time consuming task. An alternative technique is described here which makes use of a matrix of inverse filters designed to ensure that the "cross talk" from loudspeaker 1 to listeners ear 2 and loudspeaker 2 to listeners ear 1 is minimised. Again, least squares techniques are used to design this "cross talk cancellation matrix" as described specifically in references [1, 2]. This procedure is used (as illustrated in FIG. 2) to ensure that to a good approximation $$\begin{bmatrix} C_{11}(z) & C_{12}(z) \\ C_{21}(z) & C_{22}(z) \end{bmatrix} \begin{bmatrix} H_{x11}(z) & H_{x12}(z) \\ H_{x21}(z) & H_{x22}(z) \end{bmatrix} = z^{-\Delta} \begin{bmatrix} 1 & 0 \\ 0 & 1 \end{bmatrix} \tag{4}$$

where $z^{\Delta}$ is a modelling delay of $\Delta$ samples. Once the matrix of filters $H_{x11}(z)$, $H_{x12}(z)$, $H_{x21}(z)$ and $H_{x22}(z)$ has been designed by using a least squares technique, then the filters $H_1(z)$ and $H_2(z)$ are then readily deduced for each pair of filters $A_1(z)$ and $A_2(z)$ that are used to specify the desired signals associated with each virtual source location required. This follows from the fact that using equation (4), then we can make the approximation $$\begin{bmatrix} C_{11}(z) & C_{12}(z) \\ C_{21}(z) & C_{22}(z) \end{bmatrix} \begin{bmatrix} H_{x11}(z) & H_{x12}(z) \\ H_{x21}(z) & H_{x22}(z) \end{bmatrix} \begin{bmatrix} A_1(z) \\ A_2(z) \end{bmatrix} U(z) = z^{-\Delta} \begin{bmatrix} A_1(z) \\ A_2(z) \end{bmatrix} U(z) \tag{5}$$

and therefore if we deduce the filters $H_1(z)$ and $H_2(z)$ from $$\begin{bmatrix} H_1(z) \\ H_2(z) \end{bmatrix} = \begin{bmatrix} H_{x11}(z) & H_{x12}(z) \\ H_{x21}(z) & H_{x22}(z) \end{bmatrix} \begin{bmatrix} A_1(z) \\ A_2(z) \end{bmatrix} \tag{6}$$

it follows that $$\begin{bmatrix} C_{11}(z) & C_{12}(z) \\ C_{21}(z) & C_{22}(z) \end{bmatrix} \begin{bmatrix} H_1(z) \\ H_2(z) \end{bmatrix} U(z) = z^{-\Delta} \begin{bmatrix} A_1(z) \\ A_2(z) \end{bmatrix} U(z) \tag{7}$$

Since the reproduced signals are given by $$\begin{bmatrix} W_1(z) \\ W_2(z) \end{bmatrix} = \begin{bmatrix} C_{11}(z) & C_{12}(z) \\ C_{21}(z) & C_{22}(z) \end{bmatrix} \begin{bmatrix} H_1(z) \\ H_2(z) \end{bmatrix} U(z) \tag{8}$$

it thus follows that, with $H_1(z)$ and $H_2(z)$ given by equation (6), the reproduced signals are $$\begin{bmatrix} W_1(z) \\ W_2(z) \end{bmatrix} \approx z^{-\Delta} \begin{bmatrix} A_1(z) \\ A_2(z) \end{bmatrix} U(z) \approx z^{-\Delta} \begin{bmatrix} D_1(z) \\ D_2(z) \end{bmatrix} \tag{9}$$

In other words, the reproduced signals are, to a very good approximation, equal to the desired signals delayed by $\Delta$ samples. Thus, apart from this additional delay, the objective is met of reproducing the signals due to the virtual source.

Thus by first designing the matrix of cross talk cancellation filters, the filters $H_1(z)$ and $H_2(z)$ can be designed simply by convolving the impulse responses of the filters $A_1(z)$ and $A_2(z)$ associated with a given virtual source location with the impulse responses of the appropriate elements of the cross talk cancellation matrix. Thus, using lower case letters to denote the impulse response, it follows that $$h_1(n)=[h_{x11}(n)*a_1(n)]+[h_{x12}(n)*a_2(n)] \tag{10}$$

$$h_2(n)=[h_{x21}(n)*a_1(n)]+[h_{x22}(n)*a_2(n)] \tag{11}$$

where the symbol * denotes convolution.

The numerical computation required in order to deduce these impulse responses is therefore vastly reduced compared to that required if $h_1(n)$ and $h_2(n)$ were deduced by solving the least squares problem of optimally designing $H_1(z)$ and $H_2(z)$ for each location of virtual source.

3. Extension of the filter design procedure for use in loudspeaker position compensation systems We shall also note here that the filter design procedure outlined above can, in accordance with the invention, be used to assist the design of inverse filters used in loudspeaker position compensation systems. These have been described fully in references [3] and [4]. In that case, the objective is to design a matrix of filters used to operate on the two signals of a conventionally produced stereophonic recorditng. The filters are designed in order that "virtual sources" appear to be produced to a listener that would give the best reproduction of conventionally recorded stereophonic signals. The block diagram associated with such a system is illustrated in FIG. 3. Again we note that using equation (4) shows that $$\begin{bmatrix} C_{11}(z) & C_{12}(z) \\ C_{21}(z) & C_{21}(z) \end{bmatrix} \begin{bmatrix} H_{x11}(z) & H_{x12}(z) \\ H_{x21}(z) & H_{x22}(z) \end{bmatrix} \begin{bmatrix} A_{11}(z) & A_{12}(z) \\ A_{21}(z) & A_{22}(z) \end{bmatrix} \begin{bmatrix} U_1(z) \\ U_2(z) \end{bmatrix} \approx z^{-\Delta} \begin{bmatrix} A_{11}(z) & A_{12}(z) \\ A_{21}(z) & A_{22}(z) \end{bmatrix} \begin{bmatrix} U_1(z) \\ U_2(z) \end{bmatrix} \tag{12}$$

We therefore design the matrix of inverse filters in accordance with $$\begin{bmatrix} H_{11}(z) & H_{12}(z) \\ H_{21}(z) & H_{22}(z) \end{bmatrix} = \begin{bmatrix} H_{x11}(z) & H_{x12}(z) \\ H_{x21}(z) & H_{z22}(z) \end{bmatrix} \begin{bmatrix} A_{11}(z) & A_{12}(z) \\ A_{21}(z) & A_{22}(z) \end{bmatrix} \tag{13}$$

and the filter design procedure is again simplified by first designing the cross talk cancellation filter matrix. This again follows from identical reasoning to that given above. In this case however, it follows that the reproduced signals are given by $$\begin{bmatrix} W_1(z) \\ W_2(z) \end{bmatrix} = \begin{bmatrix} C_{11}(z) & C_{12}(z) \\ C_{21}(z) & C_{22}(z) \end{bmatrix} \begin{bmatrix} H_{11}(z) & H_{12}(z) \\ H_{21}(z) & H_{22}(z) \end{bmatrix} \begin{bmatrix} U_1(z) \\ U_2(z) \end{bmatrix} \tag{14}$$

and with the inverse filters designed in accordance with equation (13) it follows that $$\begin{bmatrix} W_1(z) \\ W_2(z) \end{bmatrix} \approx z^{-\Delta} \begin{bmatrix} A_{11}(z) & A_{12}(z) \\ A_{21}(z) & A_{22}(z) \end{bmatrix} \begin{bmatrix} U_1(z) \\ U_2(z) \end{bmatrix} \approx z^{-\Delta} \begin{bmatrix} D_1(z) \\ D_2(z) \end{bmatrix} \tag{15}$$

The reproduced signals are again simply delayed versions of the desired signals, and the objective of the loudspeaker position compensation system is met 4. Extension of the technique for reproduction by multiple loudspeakers The approach to the placement of virtual source images described above can readily be extended for use in sound reproduction systems which make use of more than two loudspeakers. Assume that L loudspeakers are used for reproduction. Assume also that we specify the desired signals to be those produced at M locations in the region of the listeners head. These can be deduced by measuring the vector of order M of transfer functions between the virtual source location and positions on, or in the region of, a dummy head (or they are specified analytically or empirically). We define this vector to be given by $$a(z)=[A_1(z)\ A_2(z)\ \ldots\ A_m(z)]^T \tag{16}$$

and the vector of desired signals to be given by $$d(z)=a(z)\ U(z) \tag{17}$$

We also measure, or otherwise specify, a matrix of transfer functions relating the vector of reproduced signals (at the M positions in the region of the head) to the vector of loudspeaker input signals such that $$w(z)=C(z)\ v(z) \tag{18}$$

where we define the vectors w(z) and v(z) to be given by $$w(z)=[W_1(z)\ W_2(z)\ \ldots\ W_M(z)] \tag{19}$$

$$v(z)=[V_1(z)\ V_2(z)\ \ldots\ V_L(z)] \tag{20}$$

and the matrix C(z) is given by $$C(z) = \begin{bmatrix} C_{11}(z) & C_{12}(z) & \ldots & C_{1L}(z) \\ C_{21}(z) & C_{22}(z) & \ldots & C_{2L}(z) \\ \cdot & & & \cdot \\ \cdot & & & \cdot \\ \cdot & & & \cdot \\ C_{M1}(z) & C_{M2}(z) & \ldots & C_{ML}(z) \end{bmatrix} \tag{21}$$

A vector of inverse filters is then specified by $$h(z)=[H_1(z)\ H_2(z)\ \ldots\ H_L(z)] \tag{22}$$

In the case where M>L, then the inverse filters can be deduced by using the techniques outlined in references [1, 2] such that the optimal vector of FIR filter coefficients is found in order to minimise the cost function $$J_3 = \sum_{m=1}^{M} E[e_m^2(n)] \tag{23}$$

where $e_m(n)$ represents the error between the desired signal $d_m(n)$ and the reproduced signal $z_m(n)$ at the m'th location in the region of the dummy head. This, however, again suffers from being a highly numerically intensive task.

If however, the number of measurement positions M is chosen to equal the number of loudspeakers L, then we may again use the efficient filter design technique described above. First note that we define an L×L cross talk cancellation matrix $H_x(z)$ such that, to a good approximation $$C(z)\ H_x(z) \approx z^{-\Delta} I \tag{24}$$

where I is the identity matrix. Using this relationship then enables us to make the approximation $$C(z)\ H_x(z)\ a(z)\ U(z) \approx z^{-\Delta} a(z)\ U(z) \tag{25}$$

The vector of inverse filters is then deduced from $$h(z)=H_x(z)\ a(z) \tag{26}$$

such that $$C(z)\ h(z)\ U(z) \approx z^{-\Delta} a(z)\ U(z) \tag{27}$$

and since the reproduced signals are given by $$w(z)=C(z)\ h(z)\ U(z) \tag{28}$$

it follows that $$w(z) \approx z^{-\Delta} a(z)\ U(z) \approx z^{-\Delta} d(z) \tag{29}$$

The vector of reproduced signals at the M=L locations in the region of the listeners head is thus simply a delayed version of the desired signals and the objective of the system is met.

This procedure thus relies again on the design of the matrix of cross talk cancellation filters $H_x(z)$. This is defined as the matrix $H_x(z)$ that operates on an L vector of signals u(z) to ensure that the signals produced at the M=L points in the region of the listeners head are simply delayed versions of these signals. In other words, the desired signals used in designing the cross talk cancellation filter matrix are given by $$d(z)=z^{-\Delta} u(z) \tag{30}$$

and the reproduced signals in this case are given by $$w(z)=C(z)\ H_x(z)\ u(z) \tag{31}$$

The matrix $H_x(z)$ is again designed by using the techniques described extensively in references [1, 2, 3, 4].

5. Frequency domain filter design techniques

In addition to the least squares time domain methods of inverse filter design that are referred to above and described in references [1–4], it is also possible to design inverse filters in the frequency domain. This can sometimes be a more efficient way of designing the cross-talk cancellation matrix, especially when using a large number of loudspeaker channels for reproduction. A number of steps have to be taken however, if a frequency domain design technique can be used effectively. Firstly the problem of the unrealisability of the inverse filters has to be dealt with by suitable choice of modelling delay in a similar way to that used in the time domain. Secondly, there is a related problem of ill-conditioning of the inversion which has to be dealt with explicitly when working in the frequency domain. This is intrinsically avoided when adaptive algorithms are used to find the least squares solution in the time domain.

The frequency domain design technique is most readily explained by using a single channel example which illustrates the potential problem of ill-conditioning. If for example, we have an electroacoustic transmission path C(z), an obvious approach to the design of the inverse filter H(z) is simply to calculate 1/C(z). Of course if C(z) is non-minimum phase (has one or more zeros outside the unit circle in the z-plane) then 1/C(z) will be unstable in forward time (since the zeros of C(z) become the poles of 1/C(z) and these are outside the unit circle). However, the unstable response of 1/C(z) in forward time can also be interpreted as a stable response in backward time. That is, one can regard 1/C(z) as having a stable but anti-causal impulse response. The problem of an anti-causal impulse response is partly compensated for by the inclusion of a modelling delay. Thus one can in principle calculate H(z) from $z^{\Delta}/C(z)$ which effectively shifts the impulse response of the inverse filter by Δ samples in the direction of positive time. If, however, one of the zeros of C(z) that is outside the unit circle is close to the unit circle, then the decay of the impulse response in reverse time will be slow (the pole is lightly damped). This will result in significant energy in the impulse response of the "ideal" inverse filter occurring for values of time less than zero. Similarly, if one of the zeros of C(z) inside the unit circle is close to the unit circle, the decay of the impulse response in forward time will be slow, and the inverse filter required will have a very long impulse response in forward time. A technique for helping to alleviate this problem is to introduce a parameter in order to "regularise" the design of the inverse filter. This has the effect of damping the poles of the inverse filter and moving them away from the unit circle, thus curtailing the impulse response of the inverse filter in both forward and negative times.

This argument can be demonstrated explicitly in the single channel case by considering a specific example. We first define the cost function to be minimised by the squared modulus of the Fourier transform of the error signal (the difference between the desired and reproduced signals) plus a term which is proportional to the squared modulus of the Fourier transform of the signal output from the inverse filter. We thus seek to minimise the cost function $$j(\omega)=|E(e^{j\omega})|^2=|D(e^{j\omega})-H(e^{j\omega})C(e^{j\omega})U(^{j\omega})|^2+\beta|V(e^{j\omega})|^2 \tag{32}$$

where β is the regularisation parameter which weights the "effort" used by the inverse filter in providing an inversion. Note that the Fourier transforms used in this expression are related to the z-transforms used above by making the substitution $z=e^{j\omega}$. Thus, for example, $D(e^{j\omega})$ denotes the Fourier transform of the desired signal which has the corresponding z-transform D(z). Since the desired signal and the inverse filter output signal are respectively related to the input signal to the inverse filter (the virtual source signal) by $D(e^{j\omega})=e^{-j\omega\Delta}U(e^{j\omega})$ and $V(e^{j\omega})=H(e^{j\omega})U(e^{j\omega})$ then the expression for the cost function reduces to $$J(\omega)=|U(e^{j\omega})|^2[|e^{-j\omega\Delta}-H(e^{j\omega})C(e^{j\omega})|^2+\beta|H(e^{j\omega})|^2] \tag{33}$$

It is readily shown (see, for example, the Appendix of reference [6]) that the Fourier transform of the inverse filter that minimises this quadratic cost is given by $$H(e^{j\omega})=C^*(e^{j\omega})e^{-j\omega\Delta}[|C(e^{j\omega})|^2+\beta]^{-1} \tag{34}$$

where the superscript * denotes complex conjugation. We can write this expression in terms of z-transforms by making the substitution $z=e^{j\omega}$. Thus, since $|C(e^{j\omega})|^2$ can be written as $C^*(e^{j\omega}))C(e^{j\omega})=C(e^{-j\omega})C(e^{j\omega})$, then in terms of z-transforms $$H(z)=C(z^{-1})z^{-\Delta}[C(z^{-1})C(z)+\beta]^{-1} \tag{35}$$

Now, for example, consider the inversion of the transfer function described by $C(z)=1+az^{-1}$ where a is real. This has a single zero at z=−a and is thus minimum phase when |a|<1 and non-minimum phase when |a|>1 (i.e. when the zero is outside the unit circle). The optimal inverse filter that minimises the cost function defined above is thus given by $$H(z)=(1+az)z^{-\Delta}[(1+az)(1+az^{-1})+\beta]^{-1} \tag{36}$$

Expansion of the denominator of this expression shows that we can write $$H(z)=(1+az)z^{-\Delta}[(z-\rho1)(z-\rho2)]^{-1} \tag{37}$$

where ρ1 and ρ2 are the poles of the inverse filter. These are given by $$\rho1,\rho2=(1/2a)(1+a^2+\beta\pm\sqrt{[(1+a^2+\beta)^2-4a^2]}) \tag{38}$$

The particular case of interest is when the zeros of the system to be inverted lie close to the unit circle. In such cases the inverse filter can exhibit a very large response, since broadly speaking, the poles of the inverse filter will be close to the unit circle with a correspondingly large response in the frequency domain and long impulse response in the time domain. If, by way of illustration, we assume that the zero of C(z) lies at a=1±ϵ where ϵ is a small parameter which is of the same order as the regularisation parameter β, it follows from a series expansion of the terms in equation (38) that to the leading order of approximation, the poles of the inverse filter are given by $$\rho1,\ \rho2=1\pm\sqrt{\beta} \tag{39}$$

where terms of order β and ϵ have been neglected. This shows that there are two poles of the inverse filter, one inside and one outside the unit circle. Obviously as β is increased, then the poles move further away from the unit circle and the impulse response of the inverse filter becomes smaller in duration. In fact, a partial fraction expansion of the expression for the z-transform of the inverse filter shows that we may write $$H(z)=\frac{1}{\sqrt{\beta}}\left[\frac{z}{(z-p_1)}-\frac{z}{(z-p_2)}\right]z^{-\Delta} \tag{40}$$

where the poles ρ1 and ρ2 are given by equation (39). Now note that a Binomial expansion shows that we can write $$z/z-\rho=1+\rho z^{-1}+\rho^2+z^{<2}+\rho^3z^{-3}+\ldots \tag{41}$$

and thus the corresponding inverse z-transform is given by the sequence 1, ρ, $\rho^2$, $\rho^3$, . . . Thus the pole $\rho2=1-\sqrt{\beta}$ results in a sequence which decays with increasing time, the rate of decay being determined by the value of $\sqrt{\beta}$. However the pole $\rho1=1+\sqrt{\beta}$ will result in a corresponding sequence which grows with increasing time i.e. since the pole is outside the unit circle the resulting contribution to the impulse response will be unstable. Nevertheless, as emphasised above, this unstable response in forward time has the dual interpretation as a stable response in backward time. This is most easily appreciated by noting that z/(z-p) can also be written as (-z/p)/(1-(z/p)) and that subsequent use of the Binomial expansion shows that $$\frac{z}{z-p} = -\frac{z}{p}\left[1+\frac{z}{p}+\frac{z^2}{p^2}+\frac{z^3}{p^3}+\ldots\right] \tag{42}$$

Thus the value of $\sqrt{\beta}$ will again determine the rate of decay of the sequence in backward time, a larger value of $\sqrt{\beta}$ resulting in a more rapid decay. The use of the regularisation parameter $\beta$ is thus shown to ensure that the impulse response of the inverse filter decays sufficiently fast, even when the zeros of the system to be inverted lie very close to the unit circle. Finally note that the term $z^{-\Delta}$ in equation (40) contributes a delay of $\Delta$ samples to the entire impulse response. Thus if the value of $\beta$ is chosen to be sufficiently large, the response of the inverse filter in backward time can be made to decay to a negligible value within $\Delta$ samples. This ensures the causality of the inverse filter.

This containment of the duration of the impulse response of the inverse filters is very important when using a frequency domain method for their design. The basis of the technique relies on the use of the Discrete Fourier Transform (DFT) and its rapid execution using the Fast Fourier Transform (FFT) algorithm. The relevant forward and inverse transforms can be written as $$F(k) = \sum_{n=0}^{N-1} f(n)e^{-j(2\pi/N)kn} \tag{43}$$

$$f(n) = \frac{1}{N}\sum_{k=0}^{N-1} F(k)e^{j(2\pi/N)kn} \tag{44}$$

where the sequence f(n) has the corresponding DFT given by F(k) where k is used as the index to denote the discrete frequencies at which the transform is computed. One first measures the impulse response c(n) of the system to be inverted and then computes the DFT C(k) by using the FFT algorithm. The frequency response of the inverse filter is then calculated from $$H(k) = \frac{C^*(k)e^{-j(2\pi/N)k\Delta}}{C^*(k)C(k)+\beta} \tag{45}$$

The corresponding impulse response is then calculated by using the inverse transform relationship defined above. It is at this stage in the calculation that it becomes vitally important that the impulse response of the inverse filter is of a duration that is shorter than the "fundamental period" of N samples that is used in the computation of the DFT and inverse DFT. If the duration of this impulse response is greater than this value then the computation will yield erroneous results. This of course is the result of the implicit assumption that is made when using the DFT that the signals being dealt with are periodic.

In practice the steps one takes to undertake this calculation can be summarised as follows. We use $N_h$ to denote the number of filter coefficients in the inverse filter h(n), and $N_c$ to denote the duration of the impulse response c(n). $N_h$ must be a power of two (2,4,8,16,32, . . . ), and $N_h$ must be greater than $2N_c$. These are the steps necessary to calculate a causal FIR inverse filter h(n):

1. Use zero-padding of c(n) to ensure that the duration of the impulse response of the transmission path to be inverted is $N_h$ samples. For example, if $N_c$=256, and $N_h$=1024, then 768 zeros must be appended to the original response c(n).

2. Calculate the DFT of the zero-padded sequence c(n). The result is the frequency response C(k) at $N_h$ evenly spaced points.

3. Calculate the frequency response of the inverse filter at the $N_h$ frequencies from the expression $C^*(k)/(C^*(k)C(k)+\beta)$. In practice it is only necessary to calculate the first $(N_h/2)+1$ values of this expression because of the symmetry properties of the DFT of a real sequence.

4. Calculate the inverse DFr of the expression $C^*(k)/(C^*(k)C(k)+\beta)$.

5. Find h(n) by swapping the first and second half of this inverse DFT. For example, if the inverse DFT is the sequence [1,2,3,4,5,6,7,8], then h(n)={5,6,7,8,1,2,3,4}. This operation implements a modelling delay of $N_h/2+1$. The modelling delay is thus chosen to be half the length of the impulse response of the inverse filter.

The extension of this technique to the multi-channel case is straightforward. First note that we seek the matrix of inverse filters that minimises the cost function $$J(\omega)=e^H(e^{j\omega})e(e^{j\omega})+\beta v^H(e^{j\omega})v(e^{j\omega}) \tag{46}$$

where $e(e^{j\omega})$ is the vector of Fourier transforms of the error signals (i.e the vector of signals defining the difference between the desired and reproduced signals) and $v(e^{j\omega})$ is the vector of Fourier transforms of the output signals from the matrix of inverse filters. It can readily be shown (see reference [7] for details of the analysis) that the matrix of inverse filters that minimises this cost function is given by $$H_o(e^{j\omega})=[C^H(e^{j\omega})C(e^{j\omega})+\beta I]^{-1}C^H(e^{j\omega})e^{-j\omega\Delta} \tag{47}$$

where I is the identity matrix and it has been assumed that the vector of desired signals is simply equal to the vector of recorded signals delayed by $\Delta$ samples. Note that the regularising parameter $\beta$ plays an identical role in the multi-channel case to that in the single channel case, although its use here also ensures that the matrix to be inverted is well conditioned which is an extremely important feature of this solution. The steps to be undertaken in order to compute the inverse filter matrix can thus be summarised as follows.

1. Having measured the impulse response of all the electroacoustic transmission paths use zero-padding of elements of C(n) to ensure that the duration of the impulse responses are $N_h$ samples.

2. Calculate the DFTs of the zero-padded impulse responses. The result is the frequency responses C(k) at $N_h$ evenly spaced points.

3. Calculate the frequency responses of the inverse filters at the $N_h$ frequencies from the expression $[C^H(k)C(k)+\beta I]^{-1}C(k)$. In practice, it is only necessary to calculate the first $N_h/2+1$ values of each element in this matrix. This is again because of the symmetry properties of the FFT of a real sequence. Note that this expression can be used regardless of the numbers of loudspeaker channels and number of measurements made in the reproduced field since the matrix $C^H(k)C(k)+\beta I$ cannot be singular when $\beta>0$.

4. Calculate the matrix of inverse DFTs of this expression.

5. Find the impulse responses of the inverse filters by swapping the first and second half of the inverse FFTs of each of the elements of the matrix of inverse DFTs. This operation implements a modelling delay of $(N_h/2)+1$ samples.

6. Subjective experiments on a two loudspeaker system 6.1 A review of previous experiments The creation of the illusion in a listener that a sound source is located in a given spatial position has long been a goal of acoustical engineers. It has been appreciated for many years [8] that relatively simple signal processing schemes can be used to operate on signals fed to a pair of loudspeakers in order to produce the illusion in a listener that the sound originates from a "phantom" or "virtual" source placed somewhere between the loudspeakers. Such techniques form the basis of conventional stereophonic, the psychoacoustical basis for which has been thoroughly reviewed by Blauert [9] under the category of "summing localisation". Simply providing a difference in level (or time delay) between the two signals input to a pair of loudspeakers placed appropriately with respect to the listener enables the image of the virtual source to be shifted in position between the two loudspeakers. A more sophisticated signal processing scheme is that of Atal and Schroeder [5] who are generally attributed with its invention, although a similar procedure had previously been investigated by Bauer [10] within the context of the reproduction of dummy head recordings. Atal and Schroeder devised a "localisation network" which processed the signal to be associated with the virtual source prior to being input to the pair of loudspeakers. As described above, the principle of the technique was to process the virtual source signal via a pair of filters which were designed in order to ensure that the signals produced at the ears of a listener were substantially equivalent to those produced by a source chosen to be in the desired location of the virtual source. The filter design procedure adopted by Atal and Schroeder assumed that the signals produced at the listeners ears by the virtual source were simply related by a frequency independent gain and time delay. This frequency independent difference between the signals at the ears of the listener was assumed to be dependent on the spatial position of the virtual source. These assumptions resulted in the analytically tractable design of a localisation network whose parameters could be varied in order to provide apparently different locations of the virtual source. Although a comprehensive subjective evaluation of this technique does not appear to have been undertaken by the inventors, the method was reported [5] to be effective in producing the illusion in the listener of virtual sources located in the horizontal plane at angles of azimuth of up to ±60° (i.e. outside the range of angular locations of ±30° typically achieved with intensity stereo [9]). However, the inventors also reported that beyond ±60° "localisation is less well defined since it is more strongly dependent on frequency".

Schroeder et al [11] later applied the essence of this method to the loudspeaker reproduction of dummy head recordings. In this case, the signals recorded at the ears of a dummy head were processed via a filter network which ensured that substantially the same signals were reproduced at the ears of a listener by a pair of loudspeakers. This network ensured the cancellation of the "cross-talk" between the right loudspeaker and left ear, and vice-versa Again, no thorough subjective experiments were presented but it was reported that "virtual sound sources can be created far off to the sides and even behind the listener".

The results of subjective experiments on the same type of system (i.e. dummy head recordings reproduced via a pair of loudspeakers after processing via a cross-talk cancellation network) were however reported by Damaske and Mellert [12] who dubbed the technique "TRADIS" (True Reproduction of All Directional Information by Stereophony). The results of localisation experiments in both the horizontal and median plane clearly demonstrate the effectiveness of the technique. More recently, the essence of this approach has been used by Hamada et al [13] who implement the cross-talk cancellation network digitally and refer to it as the Ortho-Stereophonic System (OSS). Again, the results of subjective experiments are presented which show remarkable accuracy in the localisation of virtual sources generated by first recording the signals produced at the ears of a dummy head and subsequently processing them via a 2×2 matrix of digital filters prior to transmission via a pair of loudspeakers. Further subjective experiments have also been presented recently by Neu et al [14] and Urbach et al [15] who again use a digital implementation of a cross-talk cancellation system to process the signals recorded at the ears of a dummy head. Again, good results are shown to be achievable, especially for virtual source positions in the horizontal plane. This general approach to the production of virtual acoustic sources has also been discussed by Cooper and Bauck [16], who refer to the technique as "Transaural Stereo" and who also discuss its generalisation to reproduction for multiple listeners [17]. Work on Transaural Stereo has also been presented by Möller [18] and by Kotorynski [19].

The filter design procedures used by all these authors generally involves the deduction of the matrix of filters comprising the cross-talk cancellation network from either measurements or analytical descriptions of the four head related transfer functions (HRTFs) relating the input signals to the loudspeakers to the signals produced at the listeners ears under anechoic conditions. The cross-talk cancellation matrix is the inverse of the matrix of four HRTFs. As recognised by Atal and Schroeder [5], this inversion runs the risk of producing an unrealisable cross-talk cancellation matrix if the components of the HRTF matrix are non-minimum phase. The presence of non-minimum phase components in the HRTFs (due to reflections from room surfaces for example [20]) can be dealt with by using the filter design procedure presented above. This allows the sound reproduction problem to be formulated in a very general way (accounting for a multiplicity of recorded signals and reproduced signals) and uses either the least squares approach in the time domain [1–4] or the frequency domain technique described above for the design of the cross-talk cancellation matrix.

In the work described here, we present the results of subjective experiments on a virtual source imaging system that is capable of producing the illusion in a listener of virtual sources located in the horizontal plane, but which has been found to operate effectively in a variety of acoustical environments. As described above, however, we revert to the original intention of Atal and Schroeder, that is we use a signal processing scheme that is capable of operating on a single signal to be associated with a virtual source and we do not make explicit use of dummy head recordings. However, we do make implicit use of a dummy head and use a set of measurements of the transfer functions between a loudspeaker input and the outputs of the ears of a dummy head. This database of dummy head HRTFs is used to filter the virtual source signal in order to produce the signals that would be produced at the ears of the dummy head by a virtual source in a prescribed spatial position. These two signals are then passed through a matrix of cross-talk cancellation filters which ensure the reproduction of these two signals at the ears of the same dummy head placed in the environment in which imaging is sought. The results of experiments are presented here for listeners in an anechoic room, in a listening room (built to IEC specifications) and inside an automobile. More details of the subjective experiments described here can be found in the MSc. Dissertation of D. Engler [21] and the PhD. Thesis of F. Orduna-Bustamante [22]. The generality of the signal processing technique described above is shown to provide an excellent basis for the successful production of virtual acoustic images in a variety of environments.

6.2 Experiments under anechoic conditions.

FIG. 4 shows the geometrical arrangement of the sources and dummy head used in first designing the cross-talk cancellation matrix $H_x(z)$ for the experiments undertaken in anechoic conditions. The loudspeakers used were KEF Type C35 SP3093 and the dummy head used was the KEMAR DB 4004 artificial head and torso, which of course was the same head as that used to compile the HRTF database. This database was measured by placing a loudspeaker at a radial distance of 2 m from the dummy head in an anechoic chamber and then measuring the impulse response between the loudspeaker input and the outputs of the dummy head microphones. This was undertaken for loudspeaker positions at every 10 degrees on a circle in the horizontal plane of the dummy head. The impulse responses were determined by using the MLSSA system which uses maximum length sequences in order to determine the impulse response of a linear system as described in reference [23]. The HRTF measurements were made at a 72 kHz sample rate and the resulting impulse responses were then downsampled to 48 kHz. The same technique was used to measure the elements of the matrix C(z) relating the input signals to the two loudspeakers used for reproduction to the outputs of the dummy head microphones. The results are depicted in FIG. 5 which shows the impulse responses corresponding to the elements of the matrix C(z). FIG. 6 shows the impulse responses corresponding to the elements of the cross-talk cancellation matrix $H_x(z)$ that was designed using the procedures described above together with the time domain least squares technique [1–4]. Again, these impulse responses are those measured at a 48 kHz sample rate. Finally, FIG. 7 shows the results of convolving the matrix $H_x(z)$ with the matrix C(z). This shows the effectiveness of the cross-talk cancellation and clearly illustrates that only the diagonal elements of the product $H_x(z)$ C(z) are significant and that equation (4) is, to a good approximation, satisfied. Note that the modelling delay Δ chosen was of the order of 150 samples.

Having designed the matrix of cross-talk cancellation filters as described above, the HRTF database was then used to operate on various virtual source signals u(n) in order to generate the desired signals $d_1(n)$ and $d_2(n)$ corresponding to a chosen virtual source location. These were then passed through the cross-talk cancellation filter matrix to generate the loudspeaker input signals. Listeners were then seated such that their head was, as far as possible, in the same position relative to the loudspeakers as that occupied by the dummy head when the cross-talk cancellation matrix was designed. Listeners were surrounded by an acoustically transparent screen (FIG. 4) and a series of marks were made inside the screen at 10 degree intervals along a line in the horizontal plane (that is, the plane containing the centre of the loudspeakers and the listeners ears). Listeners were asked to look straight ahead at the mark corresponding to 0 degrees, the loudspeakers being positioned symmetrically relative to the listener behind the screen at azimuthal locations of ±30 degrees (FIG. 4). After presentation of a given virtual source stimulus (i.e. some combination of input signal u(n) and choice of filters $A_1(z)$ and $A_2(z)$ corresponding to a given virtual source location) the listeners were asked to decide upon the angular location of the virtual source. Listeners were asked to make this decision whilst still looking straight ahead and then (if necessary) turn their heads to nominate the mark on the screen which most closely corresponded to their choice of virtual source location. No attempt was made to otherwise restrain the motion of the listeners head.

In order to provide a direct evaluation of the effectiveness of the system in producing the illusion of virtual sources in a given location, a series of experiments were also undertaken using real loudspeaker sources. These were placed at various locations on a circle of 2 m radius surrounding the listener. For each set of experiments undertaken with virtual sources, an equivalent set of experiments were undertaken with real sources. Each subject was presented with both sets of stimuli. The real sources were presented first to the subjects, with the duration of a typical experimental session being of the order of 50 minutes. The subjects were asked to return two days later for the experiments with virtual sources.

The types of signal u(n) used as inputs to both real and virtual sources consisted of speech, ⅓ octave bands of random noise centred at 250 Hz, 1 kHz and 4 kHz and also pure tones at 250 Hz, 1 kHz and 4 kHz. A summary of all the experiments undertaken is shown in Table 1. The presentation of different angular locations of both real and virtual sources was divided into three "sets" of angles. These are defined in Table 1. "Set 0" consisted of angles both to the front and to the rear of the listener whilst "Set 1" and "Set 2" contained angles only in the forward half of the horizontal plane. In each of the experiments defined in Table 1, the angles from a given set were presented in a particular sequence. Thus, for example, sequence "0A" refers to a specific order of presentation of angles from Set 0 whilst sequence "1A" refers to another sequence of presentations of angles from Set 1. The particular sequences used are specified in Table 2. Note that the order of presentation of the angles in a given sequence was chosen randomly in order that subjects could not learn from the order of presentation. In addition, an attempt was made to minimise any bias produced in the subjective judgements caused by order of presentation by ensuring that each sequence was also presented in reverse order. Thus sequence "1Ar" denotes the presentation of sequence "1A" in reverse order. Each of the experiments defined in Table 1 was undertaken by three subjects, a total of twelve subjects being tested in all. The subjects were all aged in their 20's and had normal hearing. A roughly equal division between male and female subjects was used, with at least one female being included in each group of three subjects. More details of these subjective experiments are presented by Engler [21].

The first point to be made regarding the performance of the system was that it was generally unable to produce a convincing illusion of virtual sources located to the rear of the listener. This is clearly shown by the results depicted in FIG. 8 which presents a comparison between the localisation of real and virtual sources. The squares on these figures have a side length that is directly proportional to the number of times a given "response angle" was recorded for a particular "presented angle" i.e. the number of times that the subjects responded to a given stimulus by answering that the source was located in a given angular location. The results in FIG. 8 (which are for speech signals) show that whilst the localisation of the real sources to the rear of the listener are remarkably accurate, presentations of virtual sources to the rear of the listener were very often "mirrored" to their equivalent angular locations to the front of the listener. Thus, for example, a presented angle of 150 degrees would result in a response angle of 30 degrees. It is worth pointing out, however, that although there were very few such "front-back confusions" in the case of real sources with a speech signal, these were very much in evidence when other types of stimulus signal were used with real sources, particularly so in the case of pure tones (the reader is referred to reference [21 ] for the data on these test cases).

Figure 9:
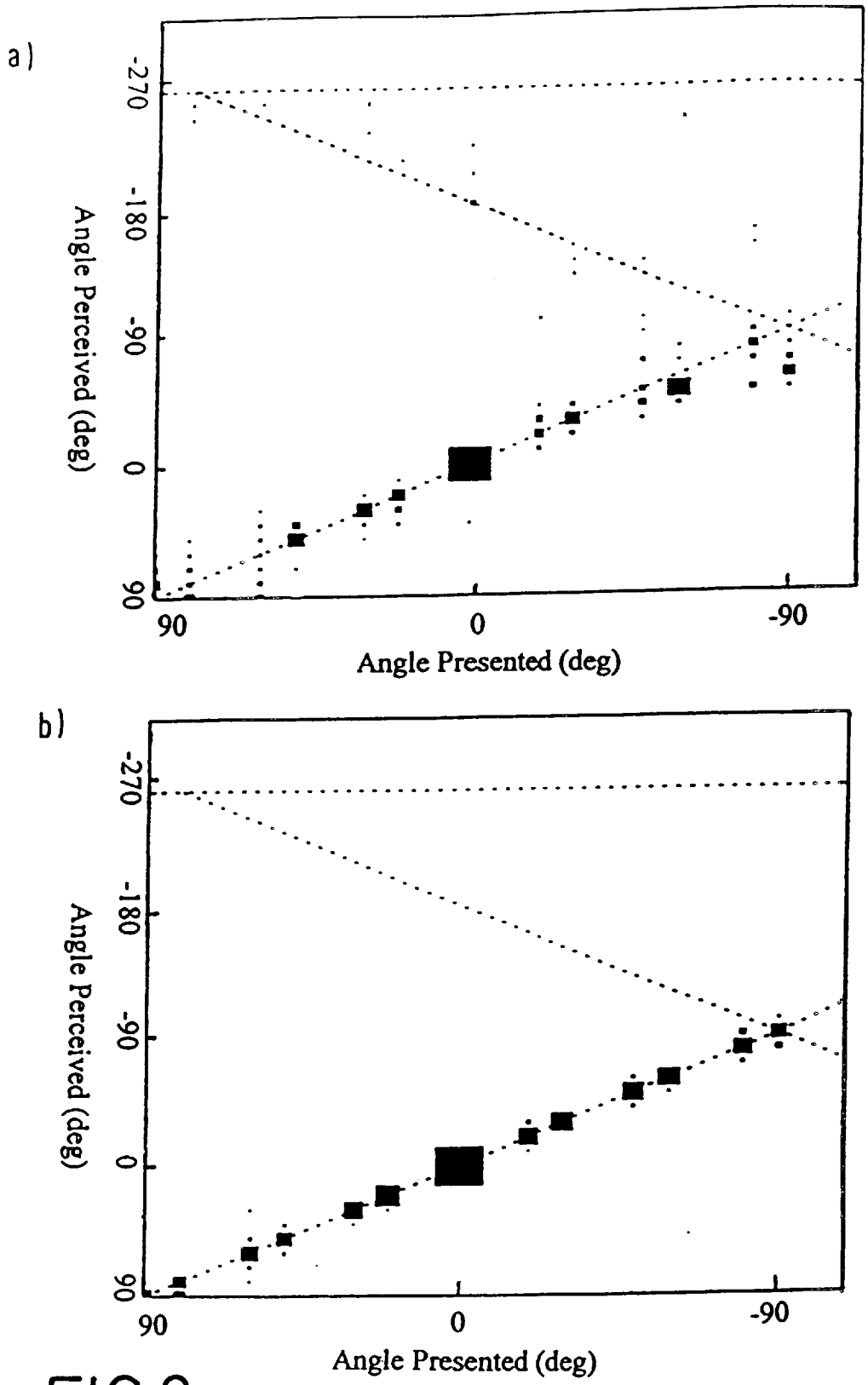

FIG. 9 shows more clearly the ability of the system to generate convincing illusions of virtual sources to the front of the listener. This is particularly so for angles within the range ±60°, although occasionally subjects again exhibited front-back confusions within this angular range. For angles outside ±60° there was a tendency for the subjects to localise the image slightly forward of the angle presented (i.e. presented angles of 90° would be localised at 80°, 70° or 60°). This is more clearly shown by the results for source signals consisting of ⅓ octave bands of white noise centred at 250 Hz, 1 kHz and 4 kHz respectively. Again occasional front-back confusion occurs, but this data shows principally that there is some frequency dependence of the effectiveness of the system. Thus the data at 4 kHz [21] shows a larger degree of "forward imaging" of virtual sources when sources are localised to the front of their intended locations at the sides of the listener. The results for pure tones [21] showed similar trends although the scatter in the data was considerably greater than in the case of ⅓ octave bands of noise.

6.3 Experiments In a listening room.

An identical experiment arrangement to that used under anechoic conditions was also used under reverberant conditions except that the experiments were undertaken inside a listening room built to IEC specifications. The geometrical arrangement of loudspeakers, listeners and screen was identical to that illustrated in FIG. 4. The response of the electroacoustic system to be inverted was, however, markedly different and is shown in FIG. 10. Comparison with FIG. 5 shows that the signals input to the loudspeakers produced a significantly stronger series of reflections at the ears of the dummy head as a result of the surfaces of the listening room. FIG. 11 shows the impulse responses of the matrix of cross-talk cancellation filters (again designed using the least squares time domain method [1–4]) and FIG. 12 shows the results of convolving these with the measured impulse responses shown in FIG. 10. Again, the filter design procedure was very effective in deconvolving the system and producing a significant net response only in the diagonal terms of the matrix product $C(z)\ H_x(z)$.

An identical series of experiments were undertaken to those described above that were perfomed under anechoic conditions. All the tests listed in Table 1 (using the sequences specified in Table 2) were repeated in the listening room. However, a different set of 12 subjects were used for the listening room tests, but the same procedures of testing with real and virtual sources were adhered to. Again, the listeners were generally in their 20's with normal hearing and distributed evenly in numbers between male and female.

Figure 13:
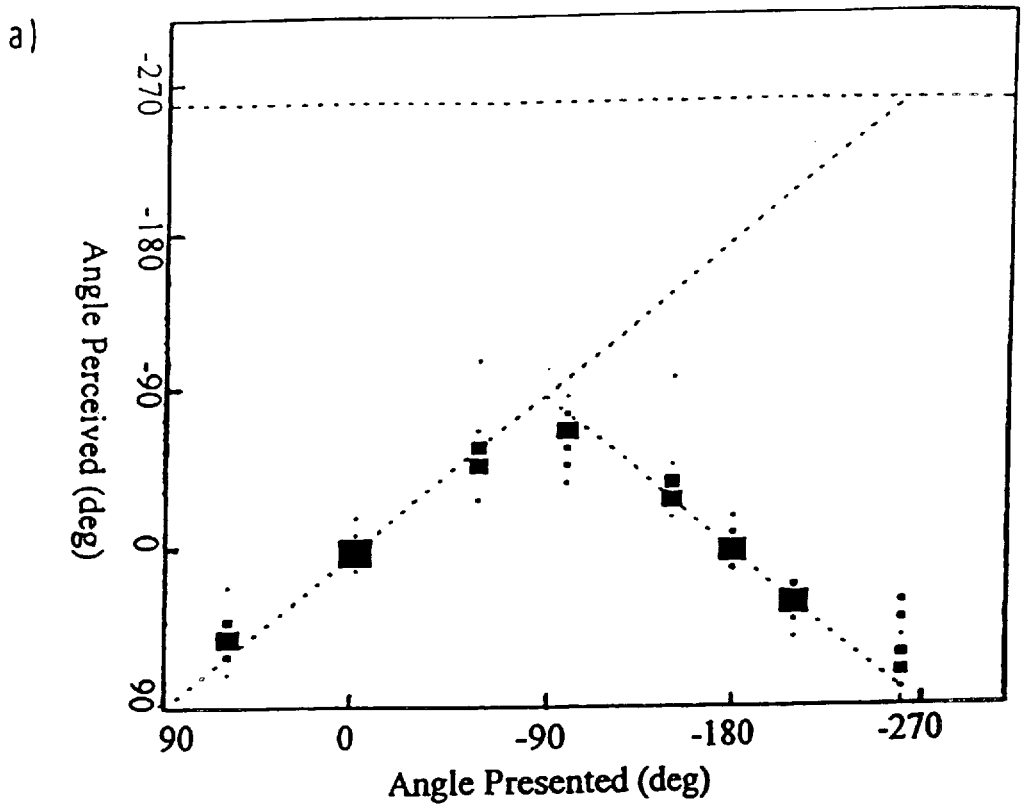
Figure 13:
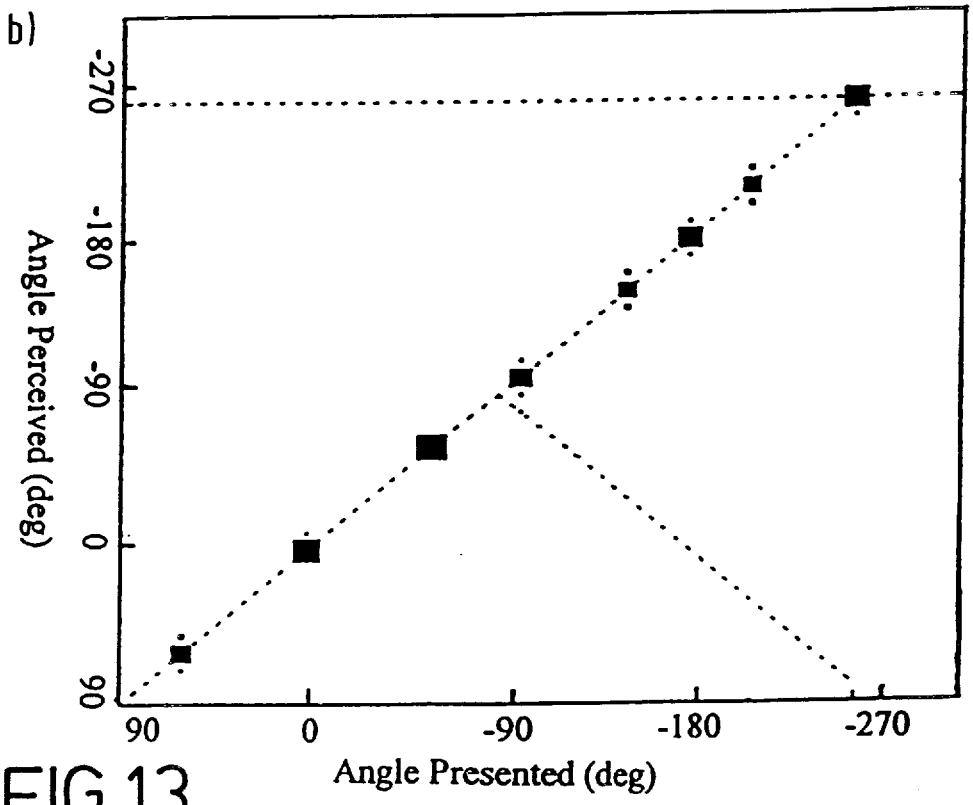

FIG. 13 shows the comparison between the effectiveness of the virtual source imaging system and the ability of the listeners to localise real speech sources. Again, the system was found to be incapable of producing convincing images to the rear of the listener, with almost all virtual source presentations in the rear of the horizontal plane being perceived in their "mirror image" positions in the fronl The results shown in FIG. 13 were again undertaken for speech signals and it should be noted that, although the results are not presented here the localisation of real sources with other signal types (pure tones and ⅓ octave bands of noise) was far less accurate than with the speech signal and showed significant numbers of front-back confusions [21].

Again, however, the system was highly effective in producing accurately located images to the front of the listener, especially in the range ±60°. This is illustrated in FIG. 14 which also shows fewer front-back confusions than observed in the equivalent experiments performed under anechoic conditions (FIG. 9). The results in FIG. 14 also shows the tendency of the system to produce "forward images" of those virtual sources to either side of the listener. This tendency was again shown by the results produced by ⅓ octave bands of noise being especially marked at 4 kHz. It is also interesting to note that at 250 Hz the data shows significantly greater scatter than at the same frequency under anechoic conditions. In the additional data presented by Engler [21], it is also shown that the localisation of pure tone virtual sources in a reverberant environment was generally poor, with results at 1 kHz and 4 kHz being scattered similarly to those measured under anechoic conditions and those at 250 Hz showing a degree of scatter that was markedly greater than those measured under anechoic conditions.

6.4 Experiments Inside an automobile

As a final, and more challenging, test of the ability of the system to produce convincing virtual acoustic sources, some brief experiments were undertaken in the interior of an automobile. The car used was an ISUZU I-Mark XS left hand drive vehicle. The existing audio system loudspeakers were used to generate the signals presented to the listeners, these loudspeakers being fitted into the underside of the vehicle dash-board facing downwards at an angle of approximately 45° to the horizontal. An approximate dimensional drawing of the arrangement is shown in FIG. 15. The loudspeakers were placed in a position well below the horizontal plane containing the listeners ears. Both the dummy head used to design the matrix of cross-talk cancellation filters and the listeners were placed in equivalent positions in the drivers seat on the left hand side of the vehicle.

The impulse response of the loudspeaker/vehicle interior combination proved quite difficult to invert satisfactorily, the design of the matrix of cross-talk cancellation filters being made difficult by the limited number of filter coefficients available. Some attempt was made to ease this situation through damping the car interior by adding anechoic wedges to the boot space at the rear of the vehicle. The impulse responses comprising the matrix of electroacoustic transfer functions once this treatment was installed are shown in FIG. 16. The form and duration of these impulse responses is clearly very different to those measured in the anechoic room and the listening room, with substantial energy in the impulse response arriving well after the direct sound. This, of course, is a natural consequence of the highly reflective nature of the vehicle interior surfaces which are placed very close to the listener. The cross-talk cancellation filters were consequently also a very long duration and these impulse responses are shown in FIG. 17. These were again designed by using the time domain technique [1–4]. The truncation of these impulse responses produced a less effective inversion than in the cases described above, this being evident in the detailed frequency analysis of the deconvolved system transfer functions. The corresponding impulse responses of the deconvolved system are shown in FIG. 18 which do show, however, that the cross-talk cancellation was basically effective despite these difficulties.

The environment being dealt with precluded a direct comparison between real and virtual sources and therefore experiments were conducted only with virtual sources. The experiments described above showed that the system was at its most effective when using speech signals for the virtual source and therefore only speech was used in these experiments. Essentially the same approach was taken in these experiments to those described above, with subjects being asked to look directly in front, decide upon an angular location of the virtual source and then nominate a marker placed in the horizontal plane outside the car.

In addition to the judgement of angular location, the subjects were also asked to give a judgement of elevation of the virtual source, either "above", "below" or "level" with the horizontal plane. This simple test was included since, unlike the previous experiments, the loudspeakers used to generate the signals were well below the horizontal plane. The "desired signals" at the listeners ears were of course due to virtual sources in the horizontal plane. A total of 12 subjects was again used, all having normal hearing. These subjects were again different to those participating in the experiments undertaken in either the anechoic or listening rooms. A total of 38 randomly chosen angular locations of virtual source were presented to each listener.

The results of the angular localisation experiment are shown in FIG. 19. Although the general scatter of the data is somewhat larger than with the previous two test conditions using a speech source, very similar trends are evident in the data. Thus, for example, centrally placed images are reliably located and there is a tendency for "forward imaging" of virtual source locations to the side of the listener. There is also a tendency evident in the data which conflicts somewhat with the forward imaging trend. That is, for a relatively large number of tests, virtual sources presented to the side of the listener (from 60° to 90° and −60° to −90°) were all located at exactly 90° or −90°. It is possible that these results were actually derived from front-back confusions and were located by the listeners at the extremes (±90°) of the angular locations which could be chosen from on the array of markers outside the car.

The results of the elevation test demonstrate that "on average", the subjects judged the virtual sources to be in the horizontal plane, although there was considerable indeterminacy in this judgement. Significant numbers of subjects judged the virtual sources to be below the horizontal plane for virtual source locations to the left of the listener, which is perhaps not surprising in view of the relatively large angle of elevation of the left hand loudspeaker situated below the listener. In retrospect, this elevation test could have been posed better, with subjects being asked to locate the elevation of the virtual source with a range of vertical locations. What is clear from this data however, is that the subjects did not consistently judge the location of the virtual sources to be below the horizontal plane.

6.5 Discussion

The results of the above experiments demonstrate that the signal processing scheme described is a very effective means of reliably producing virtual source images to the front of listeners in the horizontal plane over a range of angles of ±60°. Furthermore, this can be accomplished in a variety of environments, almost irrespective of the complexity of the acoustic response of those environments. It should also be emphasised that this technique has proved consistently effective with a population of subjects with normal hearing, and although the cross-talk cancellation filters used have been environmentally dependent, they were not designed for individual listeners.

Certain trends were repeatedly evident in the data. For example, the system failed to produce virtual images to the rear of the subjects tested, with those presentations generally being perceived in their mirror image locations to the front of the listener. Virtual sources presented to the side of the listener suffered from "forward imaging" and were generally perceived to be to the front of the intended angular location in the horizontal plane. Thus although virtual images to the side of the listener were more difficult to produce consistently, it was found possible to produce them at angular locations outside the ±60° range.

7. The production of Images In the rear half of the horizontal plane using multiple loudspeakers.

The two-channel virtual source imaging system described above was very effective in producing images to the front of a large population of listeners and it is clearly of interest to also develop the capability to produce images to the sides and rear of listeners. It is possible to produce such images with only two loudspeakers in front of a listener as some of the previous experiments referred to above [11–15] have shown. However, this previous work has been undertaken under anechoic conditions and has used dummy head recordings to provide the source material. It is likely to be possible to produce the same effect with two loudspeakers in an arbitrary environment provided that great care and attention to detail is given to the design of the cross talk cancellation matrix. This is likely to have to be undertaken on an individual basis so that the details of the HRTF of individual listeners are accounted for. For example, it has been found possible to produce arbitrarily placed images by using headphone presentation of precisely the two signals at a listeners' eardrums that would be produced by sources to the rear and even above the listener [24, 25]. In that work, however, the HRTF of each individual (including the ear canal responses) had to be inverted to ensure presentation of the correct signals. This was also necessary to ensure that the images produced were "outside the head" of the listener, since headphone presentation is notorious for the production of images which listeners perceive to be "inside the head". Finally, the previous methods of production of side and rear images are generally very sensitive to head rotation. Although no detailed studies were conducted in the experiments on the system described here, it was found that the images produced were relatively insensitive to rotation of the listeners head, and although the image would be destroyed for large (e.g. 60 degree) rotations, they would soon be perceived to be in their correct positions when the listeners head was returned to its original position. Additionally, the image positions were found to be very stable to small (e.g less than 30 degree) rotations.

It is of great interest therefore to be able to produce images to the side and to the rear of a large population of listeners in a reliable way that is not overly sensitive to listener head rotation. It is also important to be able to accomplish this in a variety of acoustical environments. Here we outline a method for accomplishing this that is based on the multi-channel generalisation of the two channel techniques described above. The essence of the technique is to use additional loudspeakers placed to the rear of (and possibly to the sides of) the listener and to process the virtual source signal via an array of inverse filters in the manner described in Section 4 above. This shows how the filter design technique that has proved so successful for systems using two sources can be generalised for use with an arbitrary number of loudspeakers. Thus with any number of sources used for reproduction it is possible to construct a cross-talk cancellation matrix and convolve this matrix with the vector of impulse response functions that specify the signals that would be produced by the virtual source. Clearly the larger the number of channels chosen the larger is the number of points in the sound field at which the desired signals are replicated. Broadly speaking therefore, one would expect that as larger numbers of loudspeakers are chosen the more convincing will be the illusion in the listener. The challenge, however is to produce a convincing illusion of virtual sources behind and to the side of a listener with a minimum number of loudspeaker channels. It has been found in practice that a convenient and efficient means of achieving this is to use only two loudspeakers mounted to the front and two mounted to the rear of the listener. This configuration is thus the same as that used in attempts to produce the same effect by using "Quadraphonic" sound reproduction systems. However it should be emphasised here that the signal processing schemes used are very different to those originally employed in quadraphony. These early systems failed to gain general acceptance because they failed to produce reliable images as a result of using the same general methods of attributing signals to the sources as those that were used in conventional stereo reproduction. That is, the source signals were often determined simply by attributing the loudspeakers with different signal amplitudes depending on the desired position of the image. Some other simplistic signal processing schemes are also discussed by Blauert [9]. The signal processing approach described here therefore improves on quadraphonic systems in the same way in which it improves on conventional stereo systems. That is, the signal processing is capable of matching both the amplitude and phase of the desired virtual source signals in the region of the listeners ears.

Furthermore, in the particular approach described here, it is possible to ensure that the direction of arrival of the sound in the field reproduced in the region of the listeners ears closely matches that of the desired virtual source sound field. This is accomplished by careful choice of the points in the region of the listeners head at which we attempt to ensure very accurate reproduction of the virtual source signals i.e. those points in the sound field at which we use measurements to design the cross-talk cancellation matrix. There are obviously many candidate points in the region of the listeners head but one method which has been found to be very effective is to choose two points spaced close together on one side of the listeners head and a further two points spaced close together on the other side of the listeners head. This is illustrated in FIG. 20. The work described in reference [7] has shown that when a number of loudspeakers are used to surround a compact (compared to the acoustic wavelength) cluster of microphones used previously to record a sound field, and the recorded signals are then processed by a matrix of optimal inverse filters, the directional characteristics of the originally recorded field are well reproduced in the region of the microphones. This principle is used here to ensure that the dominant contribution to the simulation of a virtual source to the rear of a listener is made by the loudspeakers placed to the rear of the listener. Similarly, if virtual sources to the front of the listener are required, then the signal processing scheme ensures that it is the loudspeakers to the front of the listener that provide the dominant contribution to the reproduced sound field.

An extremely convenient method of implementing this approach is to use a dummy head in the environment in which reproduction is sought in a similar way to that used in the two channel case described above. In this case however, the cross-talk cancellation matrix is designed to ensure very accurate reproduction at the positions of the microphones in the dummy head, not only when the head is placed in the intended listener position as before, but also when the head is rotated slightly. This gives a total of four measurement positions that are used to define the 4×4 matrix C(z) relating the four loudspeaker input signals to the four positions in the region of the listeners head. The 4×4 cross-talk cancellation matrix $H_x(z)$ is then designed to ensure that equation (24) above is satisfied. This can again be achieved by using the time domain techniques described in references [1–4] or by the frequency domain techniques described in Section 5 above. This principle can obviously be extended for use with an even larger number of loudspeakers used for reproduction and could also make use of additional microphones placed on or close to the surface of the dummy head. Furthermore, it may not even prove necessary to use a dummy head and it may be possible to use a spheroidal scattering object with an array of surface mounted microphones in order to design the multi-channel cross-talk cancellation matrix. It may also be possible, of course, to use a number of microphones placed close to the head of an individual listener. Finally, it may also be useful to design the inverse filters by using an analytical, numerical, or empirical model of the HRTF in order to specify the desired virtual source signals in the region of a listeners head and thereby design the cross-talk cancellation matrix.

Nevertheless, the simple technique of using a rotated dummy head for designing a four loudspeaker virtual source imaging system has proved to be very effective in practice. Listening tests have been conducted under anechoic conditions with a system designed using dummy head measurements with a rotation of ±5 degrees as illustrated in FIG. 20 (i.e. the measurements are taken with the head rotated +5 degrees from the axis through the ears of the head and then with the head rotated through −5 degrees). The cross-talk cancellation matrix was in this case designed by using a previously measured database of HRTFs to define the matrix C(z) to be inverted (and thus the actual electroacoustic system used for reproduction was not inverted). These tests have shown that the front-back confusions referred to in the above description of a two channel reproduction system are largely eliminated. The results for a speech signal are shown in FIG. 21. It has been found that convincing virtual source images can be produced both to the side and to the rear of the listener. Experiments using larger head rotations (e.g. ±15 degrees) were also undertaken but with less success. This is likely to result from the need to ensure that the two microphones placed close together on one side of the listeners head are separated by less than one half an acoustic wavelength at the highest frequency of interest. Such a spacing will ensure that the direction of arrival of the virtual source field is reliably reproduced [7]. Note that a 10 degree rotation of the dummy head implies that the two microphone positions are linearly separated by the order of 1 cm. This in turn implies an operational bandwidth of around 16 kHz which appears to be sufficient to produce reliable images. This bandwidth is likely to be increased by using smaller angular rotations. Much larger head rotations are unlikely to produce sufficient bandwidth for a successfully operational system. Finally note that in the tests described here the frequency domain inversion technique described in Section 5 above was used. It was found to be particularly important to regularise the inversion by using the parameter β in the calculation of the cross-talk cancellation matrix using equation (47). The method of choosing the value of β was largely a matter of trial and error, although this is not difficult in view of the speed and efficiency of the computations involved. It is also possible to automate the choice of the parameter β by instituting an iterative filter design procedure.

REFERENCES

1. P. A. Nelson, S. J. Elliott and I. M. Stothers (1989). *International Patent Application No.* PCTIGB89100773 (Published as WO90100851). "Improved Reproduction of Pre-Recorded Music."

2. P. A. Nelson, H. Hamada and S. J. Elliott (1992). *IEEE Transactions on Signal Processing* vol 40 pp 1621–1632, "Adaptive inverse filters for stereophonic sound reproduction."

3. P. A. Nelson, F. Orduna-Bustamante and H. Hamada (1993). *International Patent Application* PCT/GB/93101402 (Published as WO 94/01981). "Adaptive Audio Systems and Sound Reproduction Systems." (Short title: Loudspeaker Position Compensation).

4. P. A. Nelson, F. Orduna-Bustamante and H. Hamada (1992) *Proceedings of the Audio Engineering Society U.K. Conference on Digital Signal Processing, London,* 154–174, "Multichannel signal processing techniques in the reproduction of sound."

5. B. S. Atal and M. R. Schroeder (1962). U.S. Pat. No. 3,236,949., "Apparent Sound Source Translator."

6. P. A. Nelson and S. J. Elliott (1992). *Academic Press, London,* "Active control of sound".

7. P. A. Nelson (1994). *Journal of Sound and Vibration,* vol 177, pp 447–477, "Active control of acoustic fields and the reproduction of sound".

8. A. D. Blumlein (1931). British Patent No.394325, "Improvements in and relating to sound-transmission, sound-recording and sound-reproducing systems".

9. J. Blauert (1983). MIT Press, Cambridge Mass., "Spatial Hearing".

10. B. B. Bauer (1961). *Journal of the Audio Engineering Society,* vol 9, pp 148–151, "Stereophonic earphones and binaural loudspeakers".

11. M. R. Schroeder, D. Gottlob and K. F. Siebrasse (1974). *Journal of the Acoustical Society of America,* vol 56, pp 1195–1201, "Comparative study of European concert halls: correlation of subjective preference with geometric and acoustic parameters".

12. P. Damaske and V. Mellert (1969). *Acustica,* vol 22, pp 153–162, "Sound reproduction of the upper semi-space with directional fidelity using two loudspeakers" (In German).

13. H. Hamada, N. Ikeshoji, Y. Ogura and T. Miura (1985) *Journal of the Acoustical Society of Japan* vol 6(3) 143–154. "Relation between physical characteristics of orthostereophonic system and horizontal plane localisation".

14. G. Neu, E. Mommertz and A. Schmitz (1992). *Acustica,* vol 76, pp 183–192, "Investigations on true directional sound reproduction by playing head-referred recordings over two loudspeakers: Part I" (In German).

15. G. Urbach, E. Mommertz and A. Schmitz (1992). *Acustica,* vol 77, pp 153–161, "Investigations on the directional scattering of sound reflections from the playback of head-referred recordings over two loudspeakers: Part II" (In German).

16. D. H. Cooper and J. L. Bauck (1989). *Journal of the Audio Engineering Society,* vol 37, pp 3–19, "Prospects for transaural recording".

17. D. H. Cooper and J. L. Bauck (1992). Paper presented at the 93rd Convention of the Audio Engineering Society, San Francisco, "Generalised transaural stereo".

18. H. Møller (1989). *Journal of the Audio Engineering Society,* vol 37, pp 30–33, "Reproduction of artificial-head recordings through loudspeakers".

19. K. Kotorynsid (1990). Paper presented at the 91st Convention of the Audio Engineering Society, Los Angeles, "Digital binaural stereo conversion and crosstalk cancelling".

20. S. T. Neely and J. B. Allen (1979). *Journal of the Acoustical Society of America,* vol 66, pp 165–169, "Invertibility of a room impulse response".

21. D. Engler (1995). MSc Dissertation, University of Southampton, England, "Subjective testing of a localisation system".

22. F. Orduña-Bustamante (1995). PhD Thesis, University of Southampton, England, "Digital signal processing for multi-channel sound reproduction".

23. D. D. Rife and J. Vanderkooy, 1989 *Journal of the Audio Engineering Society,* vol 37(6) "Transfer function measurement with maximum length sequences".

24. F. L. Wightman and D. J. Kistler (1989) *Journal of the Acoustical Society of America,* vol 85(2) pp 858–867. "Headphone simulation of free-field listening.1: Stimulus synthesis".

25. F. L. Wightman and D. J. Kistler (1989) *Journal of the Acoustical Society of America* , vol 85(2) pp 868–878. "Headphone simulation of free-field listening.2: Psychophysical validation".

We claim:

1. A method of recording sound for reproduction by a plurality of loudspeakers, or for processing sound for reproduction by a plurality of loudspeakers, in which some of the reproduced sound appears to a listener to emanate from a virtual source which is spaced from the loudspeakers, comprises utilizing filter means in creating the recording, or in processing the signals for supply to loudspeakers, the filter means being created by two filter design steps, comprising:

(a) specifying, in the form of filters (A), the transfer functions between said desired position of the virtual source and specific positions in the reproduced sound field which are at the ears of the listener or in the region of the listener's head; and (b) convolving said transfer function filters (A) with a matrix of cross-talk cancellation filters ($H_x$) used to invert the electro-acoustic transmission path or paths (C) between loudspeaker inputs and said specific positions, said matrix of cross-talk cancellation filters ($H_x$) being created in filter design steps for a multi-channel system, the creation comprising:

(i) measurement of the impulse response of all the electro-acoustic transmission paths using a matrix of elements C(n), and employing zero-padding of said elements C(n) to ensure that the duration of the impulse responses are $N_h$ samples;

(ii) calculation of the DFTs of the zero-padded impulse responses so as to give a matrix of frequency responses C(k) at $N_h$ evenly spaced points;

(iii) calculation of the frequency responses of the filters at the $N_h$ frequencies from the expression $[C^H(k)C(k)+\beta I]^{-1}C(k)$, where superscript "H" denotes the Hermitian transpose operator, "I" denotes the Identity matrix and $\beta$ is a regularizing parameter;

(iv) calculation of the matrix of inverse DFTs of said expression; and (v) calculation of the impulse responses of the filters by swapping the first and second half of the inverse FFTs of each of the elements of the matrix of inverse DFTs, implementing a modeling delay of $(N_h/2)+1$ samples.

2. An automobile provided with an audio system for reproducing sound, said audio system employing loudspeakers using filter means created by the method claimed in claim 1.

3. The method of claim 1, wherein a least squares technique is applied in the frequency domain, in order to create a single channel inverse filter having impulse response h(n), the least-squares technique employing filter design steps comprising:

a) use of $N_h$ to denote the number of filter coefficients in the filter h(n), and $N_c$ to denote the duration of the impulse response c(n), of the single electroacoustical transmission path wherein $N_h$ is a power of two (2, 4, 8, 16, 32 . . . ), and $N_h$ must be greater than $2N_c$, b) use of zero-padding of c(n) to ensure that the duration of the impulse response of the transmission path to be inverted is $N_h$ samples, c) calculation of the DFT (Discrete Fourier Transform) of the zero-padded sequence c(n) so as to give the frequency response C(k) at $N_h$ evenly spaced points, d) calculation of the frequency response of the filter at the $N_h$ frequencies from the expression $C^*(k)/(C^*(k)C(k)+\beta)$, e) calculation of the inverse DFT of the expression $C^*(k)/(C^*(k)C(k)+\beta)$ wherein β is a regularising parameter, and f) calculation of h(n) by swapping the first and second half of this inverse DFT.

4. The method of claim 1, wherein said transfer functions of filters A and/or C are deduced by first making measurements between the input to a real source and the outputs from microphones at the ears of (or in the region of) a dummy head used to model the effect of the "Head Related Transfer Functions" (HRTF) of the listener.

5. The method of claim 1, wherein a least squares technique is employed to minimise the time averaged error between the signals (w) reproduced at the intended position of a listener and the desired signals (d).

6. The method of claim 1, wherein said transfer functions are deduced by first making measurements on a real listener.

7. The method of claim 1, wherein said transfer functions are deduced by using an analytical or empirical model of the Head Related Transfer Function (HRTF) of the listener.

8. The method of claim 1, wherein two loudspeakers only are employed, characterised in that the transfer function filter design step is arranged such that the virtual source is placed to the front of the plane of the listener's ears.

9. The method of claim 1, wherein two loudspeakers are employed in front of the listener and at least one loudspeaker is employed to the rear of the listener.

10. The method of claim 9, in which there are two loudspeakers to the rear of the listener.

11. The method of claim 9, wherein the transfer function filter design step comprises determining the transfer functions between the desired positions of the virtual sources and four specific positions adjacent to the ears of the listener, two positions adjacent to one ear and two positions adjacent to the other ear.

12. The method of claim 11, wherein a dummy head provided with microphones at the ear positions is used in measuring said transfer functions, the dummy head being turned through a small angle in order to provide said two positions adjacent to each ear, to enable a 4×4 matrix C(z) relating to the four loudspeaker input signals to the four positions in the region of the listener's head to be determined.

13. A method of producing a multi-channel sound recording capable being subsequently reproduced by playing the recording through a multi-channel sound reproduction system, the method utilising the convoluted filter design steps claimed in claim 2.

14. A sound reproduction system comprising a plurality of loudspeakers and filter means arranged to operate on recorded signals prior to input to the loudspeakers, said filter means being created using the convoluted filter design steps claimed in claim 2.

* * * * *